US009352182B1

(12) United States Patent
Cook

(10) Patent No.: US 9,352,182 B1
(45) Date of Patent: May 31, 2016

(54) PNEUMATIC SOCK EXERCISE DEVICE

(71) Applicant: Douglas Paul Cook, Summersville, WV (US)

(72) Inventor: Douglas Paul Cook, Summersville, WV (US)

( * ) Notice: Subject to any disclaimer, the term of this patent is extended or adjusted under 35 U.S.C. 154(b) by 0 days.

(21) Appl. No.: 14/929,461

(22) Filed: Nov. 2, 2015

Related U.S. Application Data

(63) Continuation of application No. 14/527,850, filed on Oct. 30, 2014, now Pat. No. 9,205,296.

(60) Provisional application No. 61/905,609, filed on Nov. 18, 2013.

(51) Int. Cl.
*A61F 5/41* (2006.01)
*A63B 21/008* (2006.01)

(52) U.S. Cl.
CPC ..... *A63B 21/008* (2013.01); *A63B 21/0083* (2013.01)

(58) Field of Classification Search
CPC ..... A61F 5/41; A61F 5/411; A61F 5/412; A61F 5/417
See application file for complete search history.

(56) References Cited

U.S. PATENT DOCUMENTS 3,902,480 A 9/1975 Wilson
4,257,593 A 3/1981 Keiser
5,058,887 A 10/1991 Patterson
5,417,635 A 5/1995 Sell
5,531,668 A 7/1996 Mann et al.
5,688,208 A * 11/1997 Plemmons ..... A63B 21/0084 482/111
6,962,554 B2 11/2005 Keiser
7,172,538 B2 2/2007 Keiser
7,462,141 B1 12/2008 Raboin et al.
7,998,038 B2 8/2011 Keiser
8,323,158 B2 12/2012 Keiser
8,382,656 B1 * 2/2013 Brown ..... A61F 5/41 600/38
2007/0287612 A1 12/2007 Cha
2012/0077649 A1 3/2012 McConnell

* cited by examiner

*Primary Examiner* — Loan H Thanh
*Assistant Examiner* — Rae Fischer
(74) *Attorney, Agent, or Firm* — Dinsmore & Shohl LLP; Monika L. Jaensson, Esq.

(57) ABSTRACT

Embodiments relate to a pneumatic sock exercise device utilizing pneumatic resistance transmitted to a user by a pneumatic sock capable of slidable movement within a pneumatic conduit configured to be removably interfaced with a source of airflow. The pneumatic sock is a tubular structure made of a flexible material that includes various aspects and features. When an embodiment is interfaced with the source of airflow, the pneumatic sock enables airflow within the pneumatic conduit or pneumatic conduit structure to oppose the user and his/her movement of the sock in either direction (with or against airflow) during exercise. Some embodiments may include an extension means and/or an anti-friction means to extend the range of movement of the pneumatic sock. The same or other embodiments may include a housing including a pneumatic conduit structure. A cushion of a resilient material may be included in an embodiment.

19 Claims, 18 Drawing Sheets

PNEUMATIC SOCK EXERCISE DEVICE

BACKGROUND

The present invention relates to pneumatic exercise devices. One of the advantages of employing pneumatic resistance in an exercise device is to reduce acceleration forces that occur when a user increases the speed of exercise movements. Acceleration forces make it difficult for a user to train at a consistent level of resistance unless constant speed of movement is maintained; furthermore, acceleration forces may contribute to user injuries during exercise. In theory, pneumatic exercise equipment would have no acceleration forces produced due to increasing speed of user movement, if the weight of the moving parts were zero. However, in practical application pneumatic exercise equipment has moving parts with weight that can potentially generate acceleration forces during exercise. These moving parts traditionally include a pressure opposing structure such as a piston rod assembly, a user interface such as a handle, and any additional mechanical linkage components such as a cable, that may be necessary to connect a pressure opposing structure and a user interface. Furthermore, exercise devices employing pneumatic resistance are often large and expensive, with complicated moving parts to transmit pneumatic resistance to the user.

SUMMARY

The present invention is a contemporary design of a pneumatic sock exercise device that decreases acceleration forces when a user increases the speed of exercise movements and has additional advantages. Embodiments of this pneumatic sock exercise device combine the benefits of pneumatic resistance in a device that is lightweight, compact, and affordable for the typical exercise consumer. In addition, a pneumatic sock exercise device is less complicated and less intimidating than traditional designs having complicated moving parts and imposing frames. Consequently, the pneumatic sock exercise device of the present invention is a contemporary and practical design that will facilitate greater exercise participation.

Disclosed herein is a pneumatic sock exercise device, the pneumatic sock exercise device comprising a pneumatic conduit having a primary opening permitting inflow of air and a secondary opening permitting outflow of air, configured to be removably interfaced with a source of airflow, and a pneumatic sock comprising a tubular structure made of a flexible material having a proximal end and a distal end. The distal end of the pneumatic sock is slidably coupled within the pneumatic conduit and the proximal end of the pneumatic sock extends through the primary opening of the pneumatic conduit. During exercise, the distal end of the pneumatic sock shuttles along a path adjacent to the interior wall within the pneumatic conduit when the proximal end of the pneumatic sock is moved by a user on a path towards and away from the primary opening of the pneumatic conduit, whereby the pneumatic sock enables airflow within the pneumatic conduit to oppose the user and his/her movement of the sock in either direction (with or against airflow) during exercise. Throughout this application the inventor has elected to use the term "couple" as the slidable engagement (shuttling) of the pneumatic sock within the pneumatic conduit; however, the elements need not be physically joined or otherwise physically connected to be considered "coupled" for purposes of this written description and the claims.

In another aspect, the pneumatic sock exercise device comprises a pneumatic conduit having a primary opening permitting inflow of air and a secondary opening permitting outflow of air, configured to be removably interfaced with a source of airflow, a cushion made of a resilient material configured to substantially enclose the exterior walls of the pneumatic conduit, and a pneumatic sock comprising a tubular structure made of a flexible material having a proximal end and a distal end. The distal end of the pneumatic sock is slidably coupled within the pneumatic conduit and the proximal end of the pneumatic sock extends through the primary opening of the pneumatic conduit. During exercise, the distal end of the pneumatic sock shuttles along a path adjacent to the interior wall within the pneumatic conduit when the proximal end of the pneumatic sock is moved by a user on a path towards and away from the primary opening of the pneumatic conduit, whereby the pneumatic sock enables airflow within the pneumatic conduit to oppose the user and his/her movement of the sock in either direction (with or against airflow) during exercise.

In an additional aspect, the pneumatic sock exercise device comprises a housing comprising a pneumatic conduit structure having at least one primary opening permitting inflow of air and at least one secondary opening permitting outflow of air, configured to be removably interfaced with a source of airflow, and at least one pneumatic sock comprising a tubular structure made of a flexible material having a proximal end and a distal end. The distal end of at least one pneumatic sock is slidably coupled within the pneumatic conduit structure and the proximal end of at least one pneumatic sock extends through a primary opening of the pneumatic conduit structure. During exercise, the distal end of at least one pneumatic sock shuttles along a path adjacent to the interior walls within the pneumatic conduit structure when the proximal end of at least one pneumatic sock is moved by a user on a path towards and away from at least one primary opening of the pneumatic conduit structure, whereby at least one pneumatic sock enables airflow within the pneumatic conduit structure to oppose the user and his/her movement of the sock in either direction (with or against airflow) during exercise.

For purposes of contributing to an understanding of the pneumatic sock exercise device, certain aspects and advantages have been briefly summarized herein. Not necessarily all aspects and advantages may be achieved in accordance with any particular embodiment of the pneumatic sock exercise device. All embodiments are intended to be within the scope of the pneumatic sock exercise device. These and other embodiments will become readily apparent to those skilled in the art from the following detailed description having reference to the attached figures, the pneumatic sock exercise device not being limited to any particular embodiments disclosed.

BRIEF DESCRIPTION OF DRAWINGS

The pneumatic sock exercise device will now be described with reference to drawings of embodiments. The drawings are intended to illustrate various embodiments and not to limit the scope of the pneumatic sock exercise device.

DETAILED DESCRIPTION OF EMBODIMENTS

The pneumatic sock exercise device can take a variety of forms and can be used in a variety of manners as will be apparent from the description of the following embodiments. Not all of the aspects and features of the pneumatic sock exercise device need to be employed in a single embodiment. Some of the embodiments described herein include a combination of various aspects and features described in the summary, and others will include additional aspects and features. Embodiments may be adapted to various exercises and methods of exercise as would be contemplated by one skilled therein.

Embodiments of a pneumatic sock exercise device utilize resistance provided by air or airflow in a confined pneumatic chamber, a pneumatic cylinder, a hollow cylinder or tube, a hollow pneumatic conduit, a plurality of pneumatic conduits, or a housing comprising pneumatic conduit structure, and transmitted to the user by a pneumatic sock comprising a tube or a plurality of tubular sock-like structures made of a flexible material such as fabric or mesh. It is preferred that embodiments are configured to be removably interfaced with a source of airflow comprising an air evacuation source, which may include an external conduit structure such as a hose. The source of airflow may comprise the air evacuation source as depicted in FIGS. 9A, 10B, 12A, 12B, and 18.

Figure 1A:
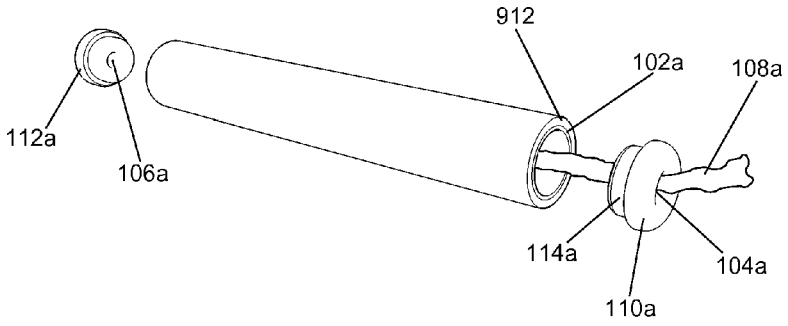
FIG. 1A depicts a perspective view of a pneumatic sock exercise device in an embodiment.
Figure 1B:
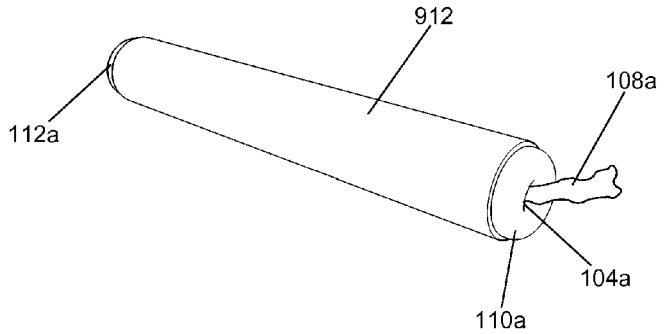
FIG. 1B depicts a perspective view of a pneumatic sock exercise device in an embodiment.

FIGS. 1A & 1B depict a perspective view of a pneumatic sock exercise device in an embodiment comprising a pneumatic conduit 102*a* having a primary opening 104*a* permitting inflow of air and a secondary opening 106*a* permitting outflow of air and a pneumatic sock 108*a* comprising a tubular structure made of a flexible material. The secondary opening 106*a* may comprise a removable connector 112*a* or fitting configured to be removably interfaced with a source of airflow, such as a hose attachment to a vacuum for household use, by a sliding or push fit in an embodiment. The pneumatic sock 108*a*, extending through the primary opening 104*a*, is slidably coupled within the pneumatic conduit 102*a*. The primary opening 104*a*, comprising a rounded flange 110*a*, a removable bushing 114*a* comprising the rounded flange 110*a*, or a flared (e.g., trumpet shaped) opening, provides a range of substantially unrestricted movement to the pneumatic sock 108*a* extending through the primary opening 104*a* of the pneumatic conduit 102*a*, thereby providing an extension means and an anti-friction means in an embodiment. The removable bushing 114*a* comprising the rounded flange 110*a* and the removable connector 112*a* may be made from strong, lightweight, and inexpensive polymers, preferably having a low coefficient of friction, including but not limited to acetal, acrylic, acrylonitrile butadiene styrene, nylon, phenolics, polycarbonate, polyester, polyethylene, polypropylene, polyvinyl chloride, polyurethane, and other such materials by molding and/or machining or other manufacturing methods. For example, the removable bushing 114*a* comprising the rounded flange 110*a* and the removable connector 112*a* may be lathed from machinable plastic rod, such as acetal rod stock, preferably of about 5 inch diameter but other diameters may be used in an embodiment. The removable bushing 114*a* comprising the rounded flange 110*a* and the removable connector 112*a* are configured to be removably interfaced with the pneumatic conduit 102*a* by a sliding or push fit in an embodiment. The primary opening 104*a* may also include extension means or anti-friction means in addition to or in place of the removable bushing 114*a* and/or the rounded flange 110*a* such as a roller, wheel, pulley, pulley system, rolling-element bearing, plain bearing, flexure bearing, fluid bearing, or a lining or coating with a low coefficient of friction or combinations thereof to provide a range of substantially unrestricted movement to the proximal end of the pneumatic sock 108*a* in an embodiment. A cushion 912 comprising a resilient material such as foam, with or without a fabric covering such as vinyl, configured as a bolster or a pad to substantially enclose the pneumatic conduit 102*a* may be included in an embodiment, thereby providing cushioning for a user and providing cushioning between the pneumatic conduit 102*a* and the floor. The pneumatic conduit 102*a* including the cushion 912 may comprise a foam roller having a rigid, hollow, cylindrical core in an embodiment. The user is able to sit, step, stand, or recline on the cushion 912 enclosing the pneumatic conduit 102*a* in an embodiment, thereby employing the user's body weight to anchor an embodiment to the floor.

Figure 1C:
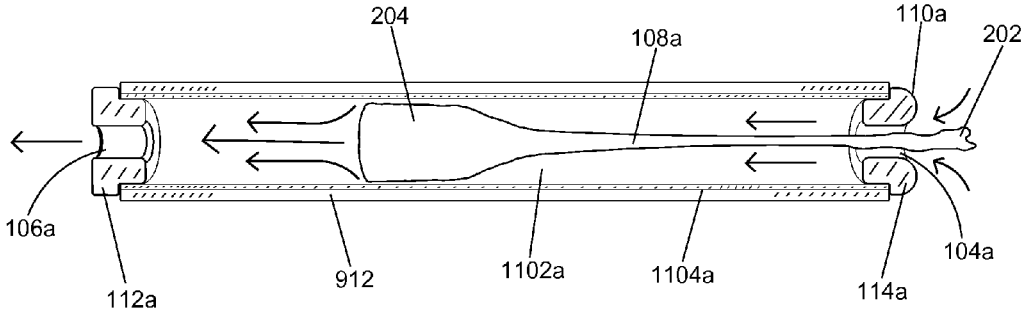
FIG. 1C depicts a cross-section view of a pneumatic sock exercise device in an embodiment.

FIG. 1C depicts a cross-section view of a pneumatic sock exercise device in an embodiment comprising the pneumatic conduit (as depicted in FIG. 1A) having an interior wall 1102*a* and an exterior wall 1104*a*, the primary opening 104*a* permitting inflow of air, the secondary opening 106*a* permitting outflow of air, the pneumatic sock 108*a*, and arrows indicating direction of airflow during operation. The pneumatic sock 108*a* has a distal end 204 slidably coupled within the pneumatic conduit 102*a* and the pneumatic sock 108*a* has a proximal end 202 extending through the primary opening 104*a* of the pneumatic conduit 102*a*. When the secondary opening 106*a* is interfaced with a source of airflow, such as a hose attachment to a vacuum for household use, the distal end 204 of the pneumatic sock 108*a* is urged by and in the direction of airflow within the pneumatic conduit 102*a* as indicated by the arrows. As a user moves the proximal end 202 of the pneumatic sock 108*a* on a path towards and away from the primary opening 104*a* during exercise, the distal end 204 of the pneumatic sock 108*a* shuttles along a path adjacent to the interior wall 1102*a* within the pneumatic conduit 102*a*. Airflow within the pneumatic conduit 102*a*, urging the distal end 204 of the pneumatic sock 108*a* in the direction of the airflow, transmits pneumatic resistance to the user during exercise as the user moves the proximal end 202 of the pneumatic sock 108*a* on a path towards and away from the primary opening 104*a*. The cushion 912 comprising a resilient material may be configured to substantially enclose the exterior wall 1104*a* of the pneumatic conduit 102*a* (as depicted in FIG. 1A) in an embodiment. For example, the cushion 912 may comprise a resilient material such as foam, preferably ranging from about ½ inch to about 1 inch in thickness, substantially enclosing and fastened to the exterior wall 1104*a* of the pneumatic conduit 102*a* with an adhesive or other fastening means in an embodiment.

The pneumatic sock 108*a* illustrated in FIGS. 1A, 1B & 1C may include aspects and features of embodiments described in this written description and depicted in FIG. 2A through FIG. 8 & FIG. 17. The pneumatic sock 108*a* is a tubular-shaped structure made of a flexible material having a proximal end and a distal end and may include tapered and non-tapered tubes and truncated cones of various dimensions, open-ended and closed-ended tubes, and bifurcated tubes. In embodiments employing a tapered pneumatic sock, the taper may be graduated from a larger distal end to a smaller proximal end to accommodate grasp or attachment to a user. It is advantageous for the pneumatic sock 108*a* to be sewn of a strong, lightweight, and abrasion resistant, flexible material such as fabric or mesh, but additional techniques such as fabric sealing, welding, gluing, or a combination thereof may be employed to make the pneumatic sock 108*a*. A slick material is advantageous to decrease friction during operation as well as to decrease the likelihood of causing skin abrasions to a user. Synthetic materials are typically stronger, lighter weight, and more abrasion resistant than natural fiber materials. Acrylic, aramid, nylon, olefin, polyester, rayon, and spandex are examples of flexible, synthetic materials that may be employed in the fabrication of the pneumatic sock 108*a*. For example, ripstop fabrics containing nylon or polyester fiber may be employed in an embodiment of the pneumatic sock 108*a* because these materials are easy to sew, strong, lightweight, abrasion resistant, resist tearing, and resist passage of air or airflow through the material. Ripstop fabrics resist tearing, and as a result, the likelihood of sudden failure (i.e. suddenly tearing apart) in an embodiment of the pneumatic sock 108*a* made with a ripstop fabric is decreased. For hygiene and infection control purposes, nylon and polyester fabrics are easily washed in laundry. Since the pneumatic sock 108*a* is removably coupled within the pneumatic conduit 102*a*, it can be removed to be washed, interchanged as a personal use item, or interchanged within a set of pneumatic socks in order to vary pneumatic resistance.

Pneumatic resistance may be varied by altering the amount of air passage or airflow through and around the pneumatic sock 108*a* and/or the material comprising the pneumatic sock 108*a* in an embodiment. The amount of air passage or airflow through the flexible material used in the fabrication of the pneumatic sock 108*a* is related to the weight, weave, thread count, thickness, ply, and other qualities of the material. For example, uncoated ripstop fabrics and many sport fabrics are typically permeable to air while providing substantial resistance to airflow to produce pneumatic resistance in an embodiment. As the pneumatic sock 108*a* shuttles within the pneumatic conduit 102*a*, the permeation of air through and/or around the pneumatic sock 108*a* is advantageous to provide pneumatic resistance as the pneumatic sock 108*a* moves in the airflow (as depicted in FIG. 1C) during exercise. An open distal end or a hole in the material near a distal end, adjustable with a drawstring or similar means, may vary or adjust air passage in an embodiment. The pneumatic sock 108*a* or the material used to fabricate the pneumatic sock 108*a* may employ an air resistant coating or a patch of material with decreased permeability to air. For example, silicone, polyurethane, PTFE, or acrylic coatings may be employed to decrease or block the passage of air or airflow through the pneumatic sock 108*a* in an embodiment. Another means of decreasing the passage of air or airflow through the pneumatic sock 108*a* includes the addition of a lightweight fill material at the distal end and filling up to as much as one half of the portion of the pneumatic sock 108*a* within the pneumatic conduit. The lightweight material may be an aggregation of amorphous material, such as shredded foam, conformable to the shape of the pneumatic conduit 102*a* or a pneumatic conduit structure in an embodiment.

Depending on its dimensions and the particular material employed, the pneumatic sock 108*a* may weigh less than three ounces in an embodiment, which permits a user to increase speed of movement during exercise without a substantial change in resistance. In addition, the lightweight, tubular structure of the pneumatic sock 108*a* substantially diminishes any "whip effect" if the user inadvertently releases the pneumatic sock 108*a* during exercise, thereby increasing user safety. The diameter of the pneumatic sock 108*a* relates to the amount of resistance that may potentially be produced in a particular embodiment. Consequently, the pneumatic sock 108*a* may have a predetermined diameter, which may be less than or up to the inside diameter of the pneumatic conduit 102*a* (as depicted in FIG. 1C), to target a potential range of resistance in an embodiment. Of course, as the diameter of the pneumatic sock 108*a* increases, the practicality of an embodiment tends to decrease due to increasing size and expense. For example, a diameter in the range of about 1 to 8 inches, with a preferred diameter range of about 1 to 4 inches, when inflated or filled is a practical size that may be fabricated at a reasonable expense in an embodiment of the pneumatic sock 108*a*. Due to the use of lightweight material such as nylon in an embodiment, the pneumatic sock 108*a* may be many feet in length but may weigh only a few ounces. For example, a length of about 4 to 18 feet, including a user interface, is a practical range for the length of the pneumatic sock 108*a* for most applications in a home or smaller facility in an embodiment. However, a length of about 4 to 12 inches may be appropriate for embodiments designed for hand exercises involving wrist and finger joints; about 12 to 48 inches may be appropriate for embodiments designed for extremity exercises involving wrist, elbow and shoulder joints; about 4 to 13 feet for embodiments designed for large movement exercises involving simultaneous movement of multiple joints of the user's body; and about 6 to 18 feet for embodiments designed to be used with an inflatable cushion or a housing comprising pneumatic conduits.

The pneumatic conduit 102*a* comprises hollow cylinders or tubes including pneumatic cylinders, pneumatic pipes, pneumatic tubes, pneumatic hoses, or pneumatic ducts, or combinations thereof, made of a rigid or a flexible material and may be linear or curved in configuration. A number of polymers may comprise the pneumatic conduit 102*a* including acrylic, acrylonitrile butadiene styrene, fluoropolymers (such as PTFE), nylon, polyester, polyethylene, polycarbonate, polypropylene, and polyvinyl chloride. In an embodiment, the pneumatic conduit 102*a* includes an inexpensive, lightweight polymer with a low coefficient of friction, such as polyethylene or polyvinyl chloride, to facilitate slidable movement of the pneumatic sock 108*a*. It is preferred that the wall of the pneumatic conduit 102*a* have a negative pressure rating up to about 14.7 lbs. per square inch in an embodiment. The wall of the pneumatic conduit 102*a* may be reinforced by various means, such as imbedded braid reinforcement, wire reinforcement, reinforcement with a stiffer polymer or other material, dual walls or a thick wall in an embodiment.

The amount of resistance that may potentially be produced by a particular embodiment increases as the diameter of the pneumatic conduit 102*a* increases. Consequently, the pneumatic conduit 102*a* may be of a predetermined diameter to achieve a targeted potential resistance or range of resistance in an embodiment. However, as the diameter of the pneumatic conduit 102*a* increases, the practicality of an embodiment tends to decrease due to increasing size and expense. For example, the pneumatic conduit 102*a* having an inside diameter range of about 1 to 8 inches, with a preferred inside diameter range of about 1 to 4 inches, is a practical size range that may be fabricated at a reasonable expense in an embodiment. The diameter of the primary opening 104*a* may approximate the diameter of the pneumatic conduit 102*a* but it is preferred that the diameter of the primary opening 104*a* is less than the diameter of the pneumatic conduit 102*a* in an embodiment. For example, the inside diameter of the primary opening 104*a* may be in a range from about 1 to 8 inches in an embodiment, with a preferred range of about 1 to 2⅜ inches inside diameter. The pneumatic conduit 102*a* may be employed in a wide range of lengths. For example, a range of about 3 to 12 feet is a practical range for the length of the pneumatic conduit 102*a* in an embodiment. A length of less than about 3 feet in an embodiment does not permit sufficient movement of the pneumatic sock 108*a* for most applications and a length of greater than about 12 feet would be an impractical size for use in most homes or smaller facilities. Further, the pneumatic sock in most embodiments will be longer (including the length of a user interface) than the length of the pneumatic conduit. However, a length of about 3 to 11 inches may be appropriate for embodiments designed for hand exercises involving wrist and finger joints; about 11 to 47 inches may be appropriate for embodiments designed for extremity exercises involving wrist, elbow and shoulder joints; about 3 to 12 feet for embodiments designed for large movement exercises involving simultaneous movement of multiple joints of the user's body; and about 5 to 12 feet for embodiments designed to be used with an inflatable cushion or a housing comprising pneumatic conduits, providing greater length to support a user and for stability.

Figure 2A:
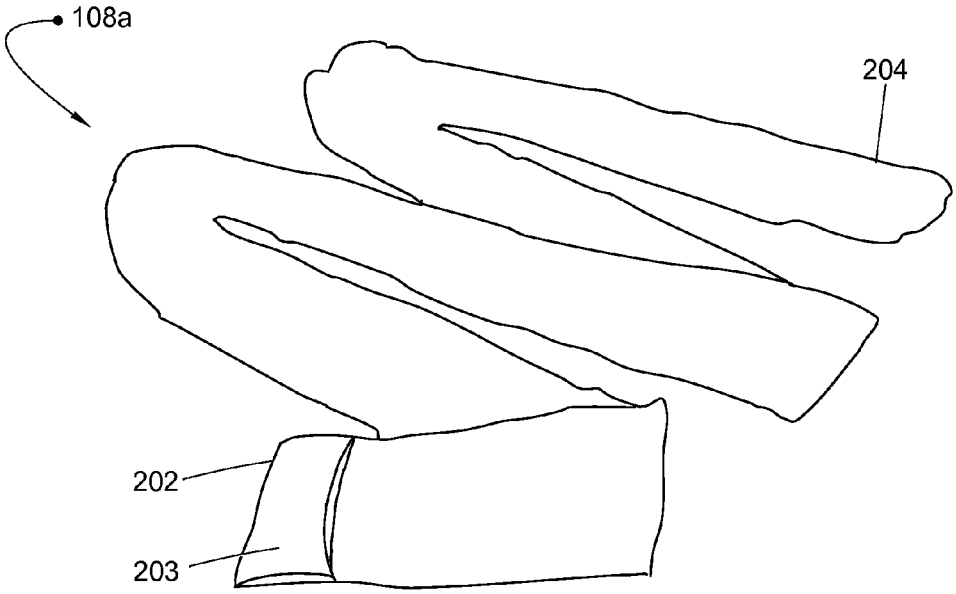
FIG. 2A depicts a perspective view of a pneumatic sock in an embodiment.
Figure 2B:
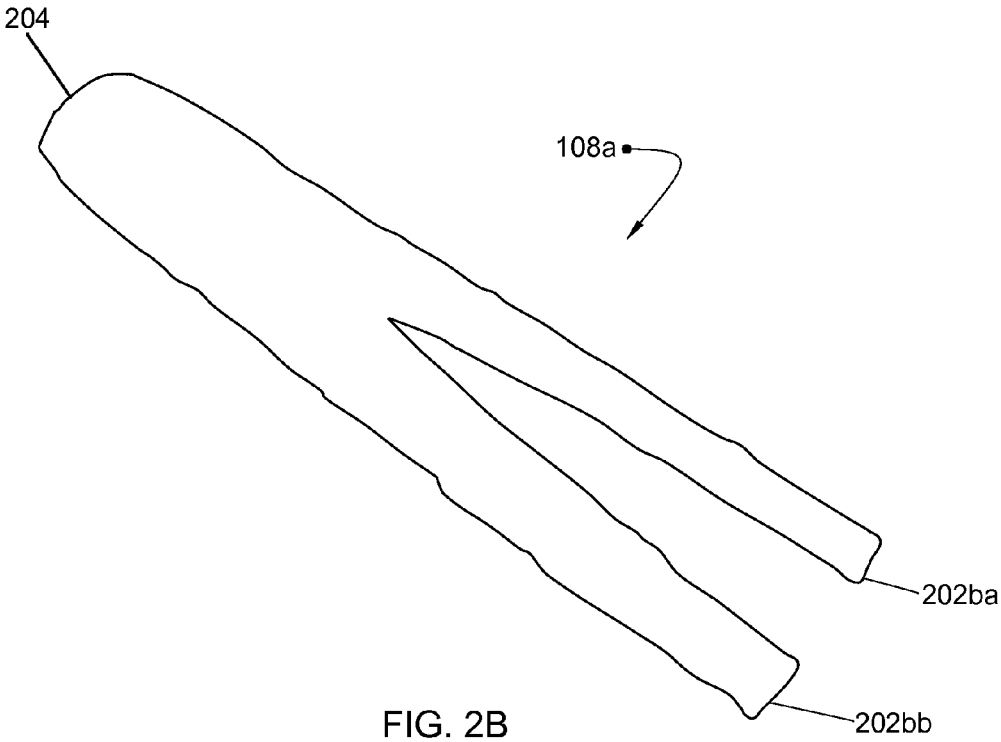
FIG. 2B depicts a perspective view of a pneumatic sock in an embodiment.

FIG. 2A depicts a perspective view of the pneumatic sock 108*a* made of a flexible material and having the proximal end 202 and the distal end 204 in an embodiment. The pneumatic sock 108*a* is easily configured to the user's extremities, such as a hand or a foot, in an embodiment. For example, the user may directly attach a hand or a foot to the pneumatic sock 108*a* by various means such as holding or wrapping the proximal end 202 in the palm of a hand. A handle, a loop, a cuff, or a pocket may also function as a user interface 203 in an embodiment. In an embodiment, the user interface 203 comprises at least one pocket with at least one opening that may be configured in different forms and manners for exercises in a variety of positions and planes of movement. FIG. 2B depicts a perspective view of a bifurcated pneumatic sock 108*a* with a pair of tapered proximal ends 202*ba*, 202*bb* in an embodiment. The pair of tapered proximal ends 202*ba*, 202*bb* may facilitate bilateral grasp or attachment to a user in an embodiment.

Figure 3A:
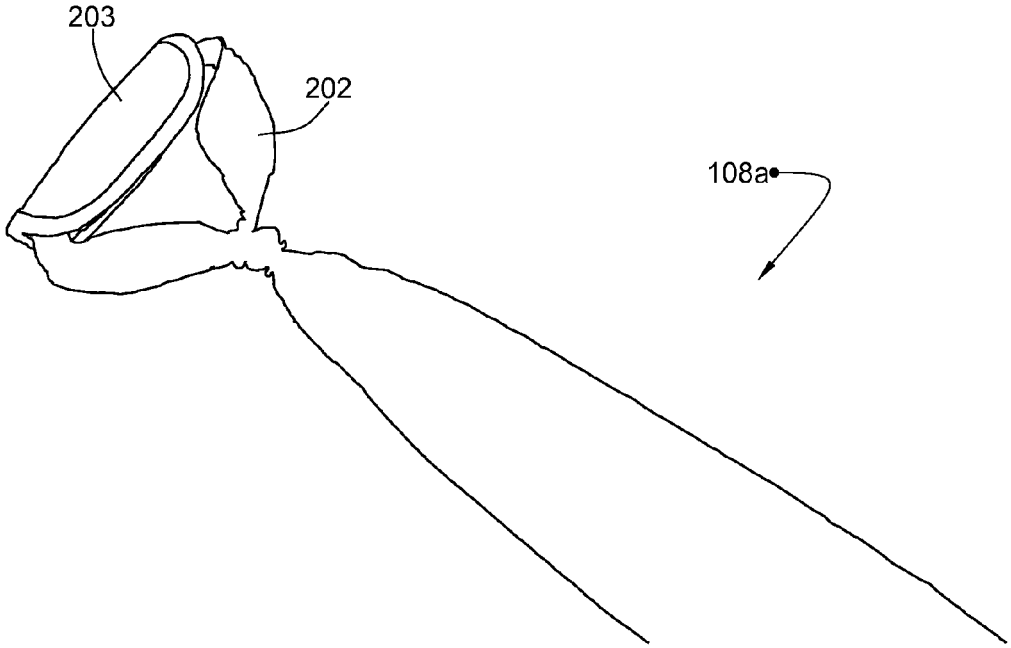
FIG. 3A depicts a perspective view of a user interface in an embodiment.

FIG. 3A depicts a partial perspective view of the pneumatic sock 108*a* with the proximal end 202 comprising the user interface 203 in an embodiment. The proximal end 202 may be grasped or wrapped in the palm of a hand by a user without the need for any additional elements or any particular configuration of the pneumatic sock 108*a*. However, in an embodiment, the user interface 203 may comprise a handle fashioned by tying or sewing a loop in the proximal end 202. The proximal end 202 and/or the user interface 203 comprising a lightweight, resilient material such as neoprene, foam, gel, felt, batting material, or a soft fabric such as fleece or flannel fabric, or other such material, may increase user comfort and facilitate engagement of the pneumatic sock 108*a* by the user. The user interface 203 may comprise a handle wrapped around and fastened to the proximal end 202 of the pneumatic sock 108*a* with a hook & loop fastener, for example, in an embodiment. For hygiene purposes, the user interface 203 comprising a handle may be removable to permit washing and interchangeable as a personal use item in an embodiment.

Figure 3B:
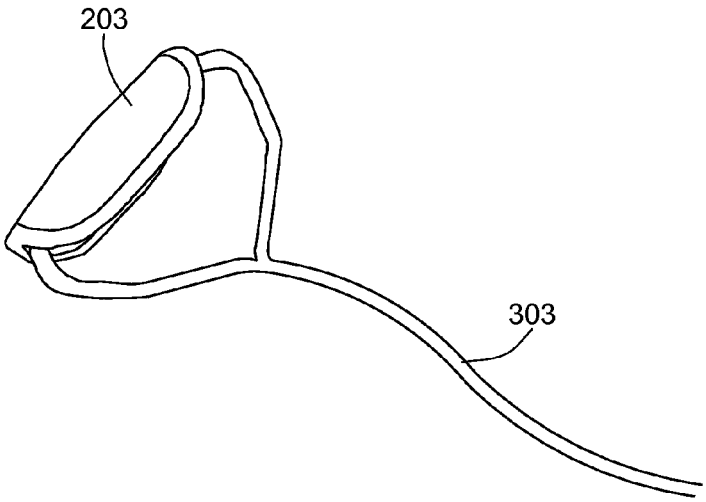
FIG. 3B depicts a perspective view of a user interface in an embodiment.

FIG. 3B depicts a partial perspective view of the user interface 203 comprising a handle and a cable 303, rope, or cord in an embodiment. The cable 303, rope, or cord may be tied or fastened to the pneumatic sock 108*a*, such as fastening to a grommet placed in the proximal end 202, in an embodiment. A pulley system may be employed to support the cable 303, rope, or cord to transmit pneumatic resistance from the pneumatic sock 108*a* to the user in an embodiment.

Figure 4:
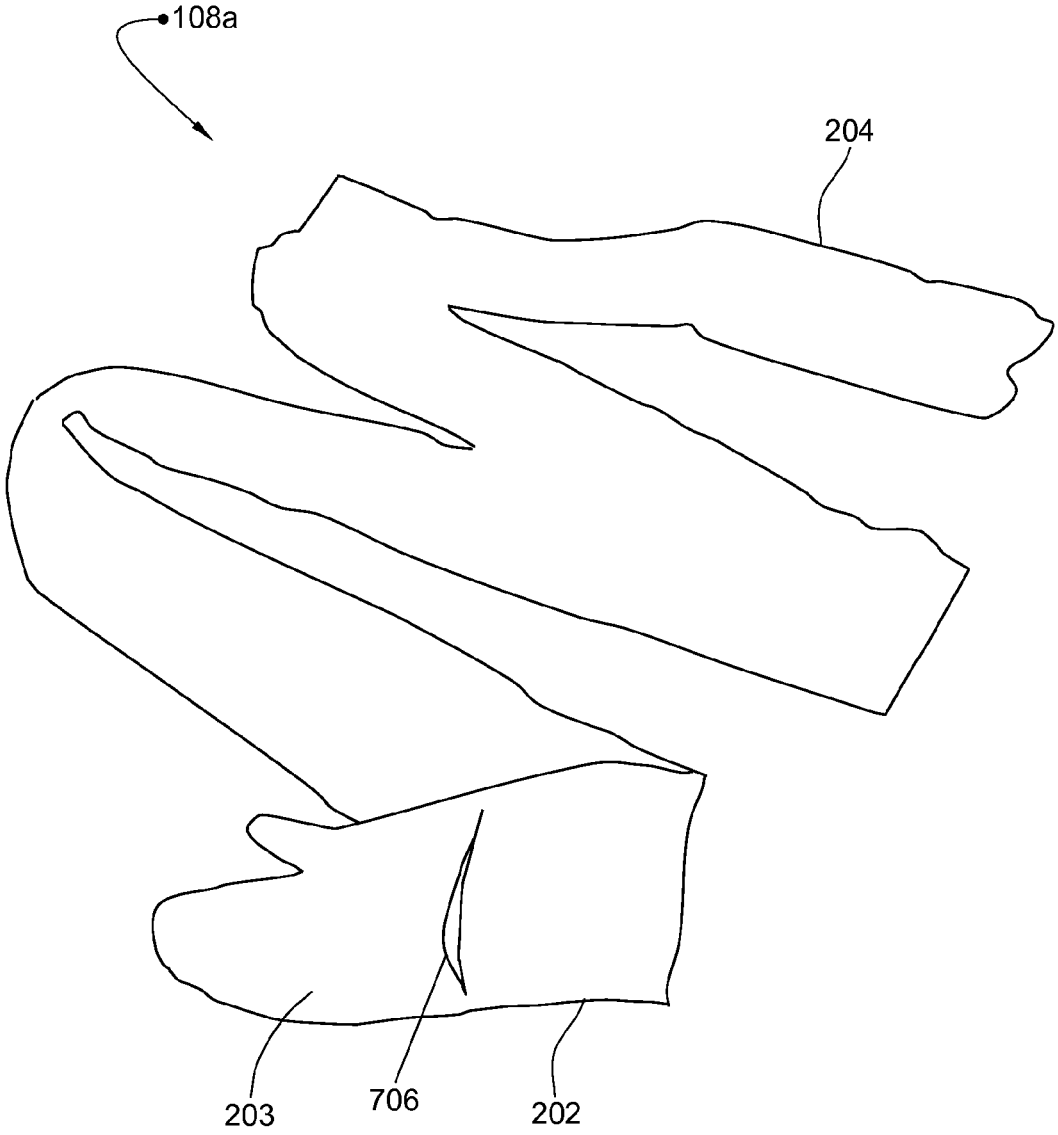
FIG. 4 depicts a perspective view of a pneumatic sock in an embodiment.

FIG. 4 depicts a perspective view of the pneumatic sock 108*a* with the distal end 204 and the proximal end 202 filled with lightweight material in an embodiment. The distal end 204 of the pneumatic sock 108*a* may comprise lightweight material, such as a resilient or plastic member or material, to enable directed airflow within the pneumatic conduit (as depicted in FIG. 1C) to oppose the user and his/her movement of the pneumatic sock 108*a* in either direction (with or against airflow) during exercise. In addition, the pneumatic sock 108*a* may comprise lightweight material in the distal end 204 and/or the proximal end 202 to deter the pneumatic sock 108*a* from being pulled through the primary or secondary openings (as depicted in FIG. 1C) by the user or by airflow during exercise. Lightweight material may comprise a single member, preferably with a circular cross-section such as a cylinder, a disc, a sphere, a cone, or a truncated cone, or lightweight material may comprise an aggregation or mass of lightweight material, such as shredded foam or polyester fiberfill, generally conforming to the shape of the distal end 204 of the pneumatic sock 108*a* in an embodiment. Lightweight material may be resilient, such as foam, or rigid, such as lightweight plastic. Lightweight material may be inserted or removed from the pneumatic sock 108*a* through an opening 706 in the proximal end 202 in an embodiment. The distal end 204 filled with lightweight material comprises a pressure opposing structure to enable airflow within the pneumatic conduit 102*a* to oppose the user and his/her movement of the sock in either direction (with or against airflow) during exercise. The proximal end 202 of the pneumatic sock 108*a* may be configured to interface with the user's extremity by means of the user interface 203 comprising a mitt or a glove with the opening 706 for insertion of the user's hand or foot and/or lightweight material, in an embodiment. The proximal end 202 comprising a mitt may include lightweight, resilient material for user comfort, such as neoprene, gel, foam, felt, batting material, or a high-loft material such as polyester fleece or other such material in an embodiment.

Figure 5A:
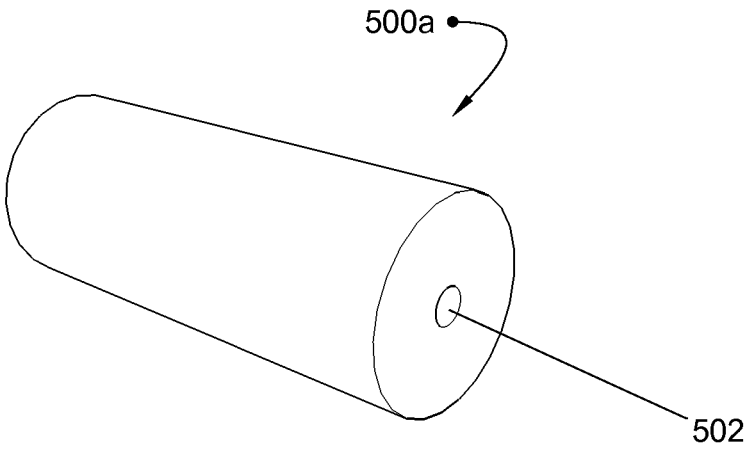
FIG. 5A depicts a perspective view of a cylinder-shaped member in an embodiment.
Figure 5B:
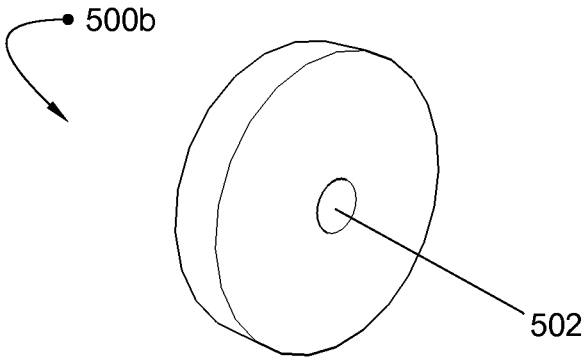
FIG. 5B depicts a perspective view of a disc-shaped member in an embodiment.
Figure 7:
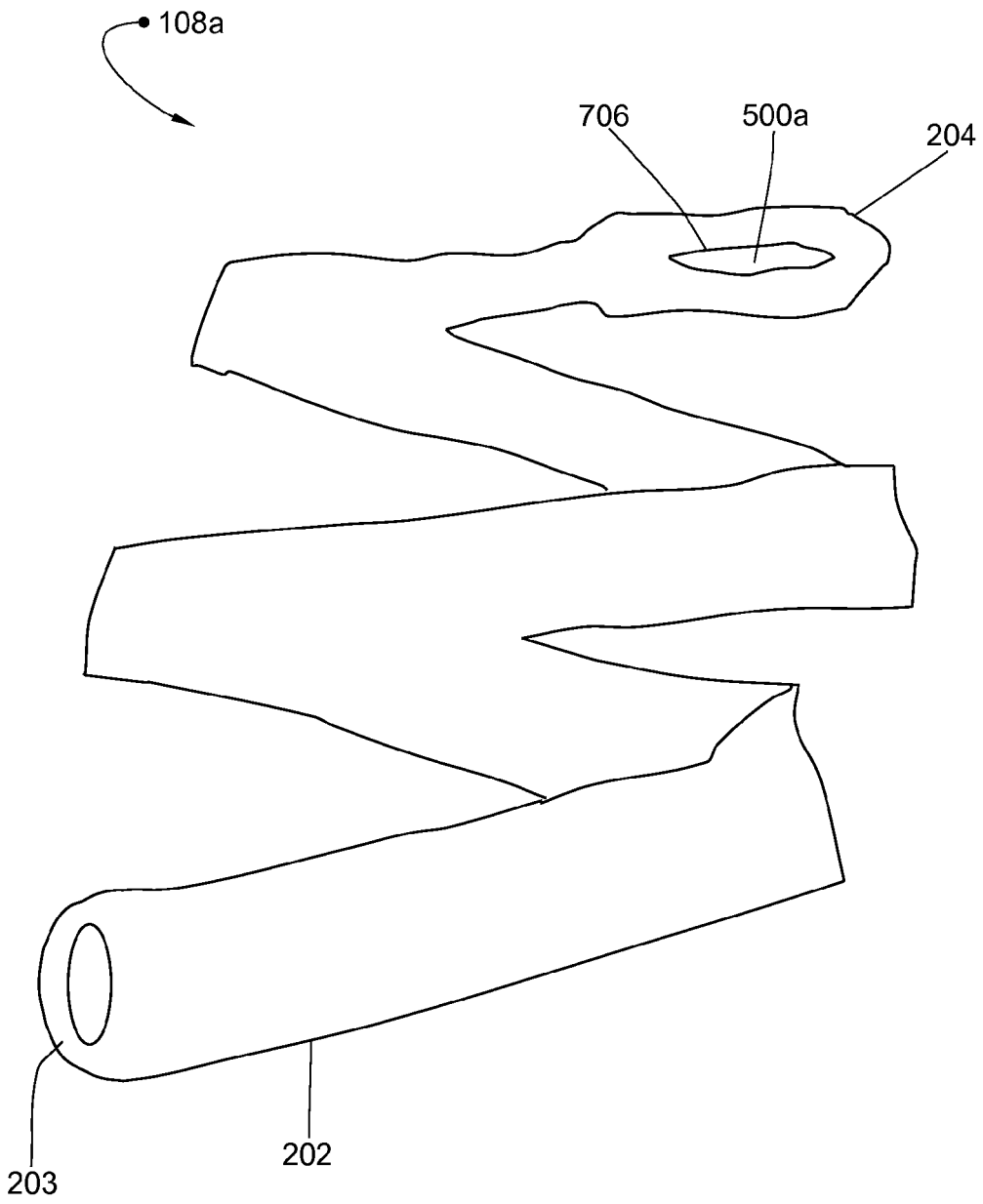
FIG. 7 depicts a perspective view of a pneumatic sock in an embodiment.
Figure 8:
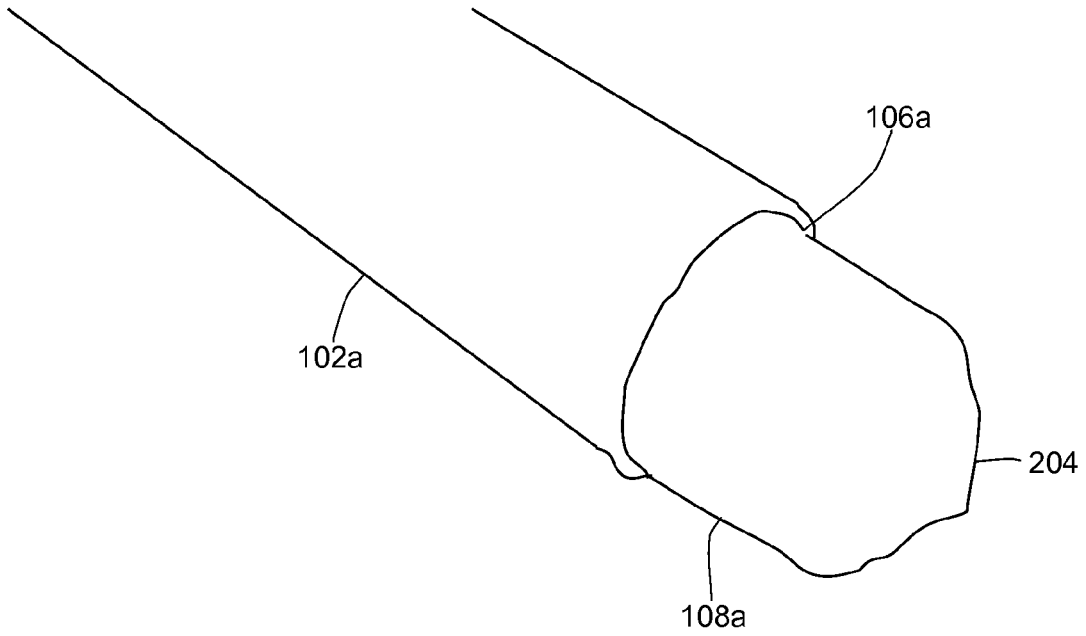
FIG. 8 depicts a partial perspective view of a pneumatic sock exercise device in an embodiment.
Figure 17:
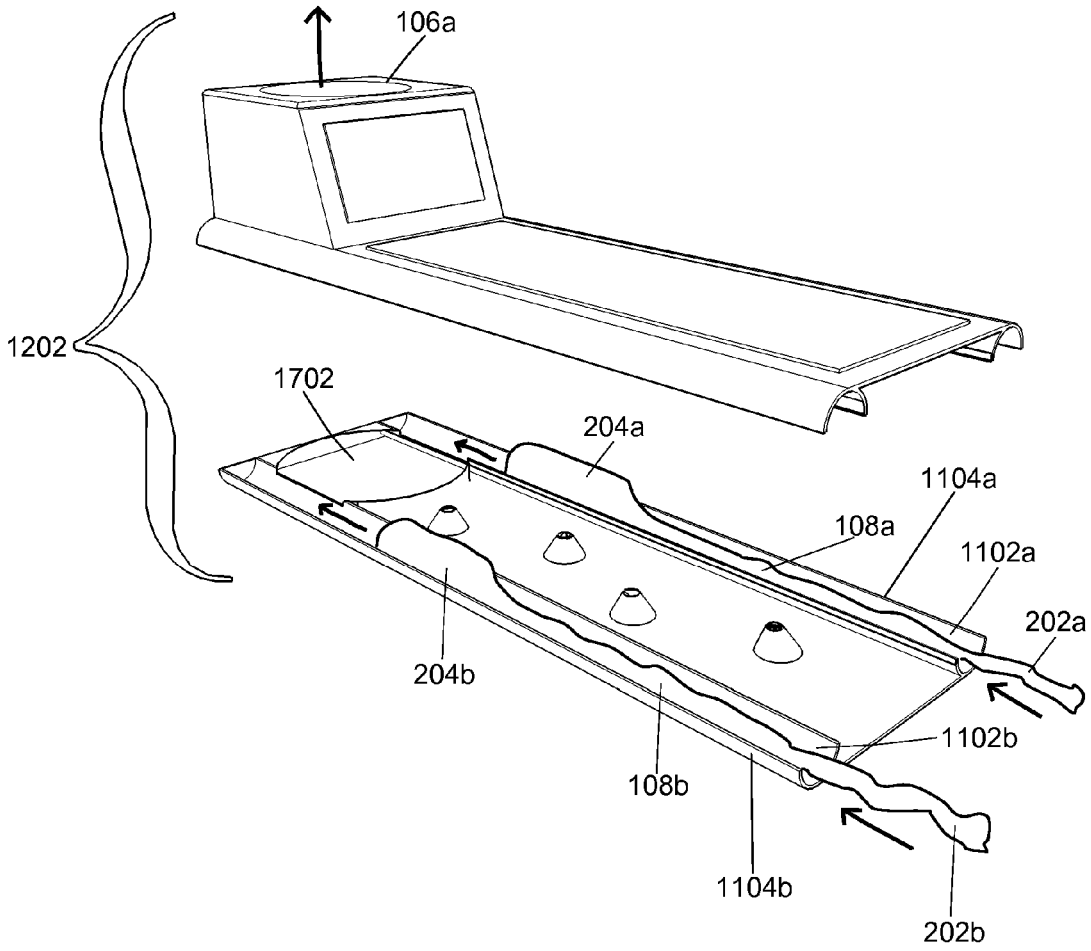
FIG. 17 depicts an exploded perspective view of a pneumatic sock exercise device including arrows to indicate direction of airflow in an embodiment.

FIG. 5*a* depicts a perspective view of a cylinder-shaped member 500*a* made of a lightweight material with a central hole 502 in an embodiment and FIG. 5*b* depicts a perspective view of a disc-shaped member 500*b* made of a lightweight material with the central hole 502 in an embodiment. The lightweight member 500*a*, 500*b* with the central hole 502 may include other shapes, preferably with a circular cross-section, conforming to the shape of the pneumatic conduit 102*a* or pneumatic conduit structure in an embodiment (as depicted in FIGS. 8 & 17.) The outside diameter and/or the inside diameter of the cylinder-shaped member 500*a* with the central hole 502 and the disc-shaped member 500*b* with the central hole 502 may be varied to vary air passage or airflow through a pneumatic sock in an embodiment. In addition, the outside circumference and/or the inside circumference of the lightweight member 500*a*, 500*b* with the central hole 502 may be scalloped or made with grooves instead of made smooth as a means of varying airflow in an embodiment. Since the resistance to air movement or airflow through the central hole 502 increases as the diameter of the central hole 502 decreases, the central hole 502 may be configured as a feature of an interchangeable member 500*a*, 500*b* to vary air passage or airflow through a pneumatic sock in an embodiment An embodiment was employed to illustrate how the member 500*a*, 500*b* with the central hole 502 (as depicted in FIGS. 5A & 5B) can be configured to vary airflow. The secondary opening 106*a* of a 4 inch schedule 40 polyvinyl chloride pipe comprising the pneumatic conduit 102*a* was interfaced with a hose attachment to a 1050-watt vacuum cleaner, with 116 cubic feet per minute airflow rating, configured as an air evacuation source 920. Using the formula V=Q/A, where V is the air velocity, Q is the airflow, and A is the cross-sectional area of the conduit 102*a*, the velocity of the airflow in this example is about 22 feet per second in the interior of the conduit 102*a*. Consequently, the velocity of the airflow is substantially greater than the velocity of typical exercise movements produced by a user, as the user moves the pneumatic sock 108*a* either towards or away from the conduit 102*a*. Plastic discs 500*b*, as depicted in FIG. 5B, measuring 3⅞ inches in outside diameter were placed in the distal end 204 of an embodiment of the pneumatic sock 108*a* (as depicted in FIG. 7) measuring about 4 inches in diameter in order of increasing diameter of the central hole 502. Initially, the plastic disc 500*b* without the central hole 502 was placed in the distal end 204 of the pneumatic sock 108*a* and a hand-held scale measured about 23 lbs. of pneumatic resistance at the proximal end 202 when the air evacuation source 920 was activated. Then, the air evacuation source 920 was de-activated and the plastic disc 500*b* without the central hole 502 was interchanged with the disc 500*b* having a ⅜ inch diameter central hole 502. When the vacuum source 920 was re-activated, the hand-held scale measured about 17½ lbs. of pneumatic resistance at the proximal end 202. Repeating this procedure using the disc 500*b* with the central hole 502 of ⅝ inch diameter resulted in pneumatic resistance of about 15 lbs., using the disc 500*b* with the central hole 502 of ¾ inch diameter resulted in pneumatic resistance of about 12½ lbs., and using the disc 500*b* with the central hole 502 of 1 inch diameter resulted in pneumatic resistance of about 10 lbs. Consequently, it is apparent from the illustration above that the central hole 502 may be configured as a feature of an interchangeable member to vary airflow or air passage through the distal end 204 of the pneumatic sock 108*a* in an embodiment.

Figure 6:
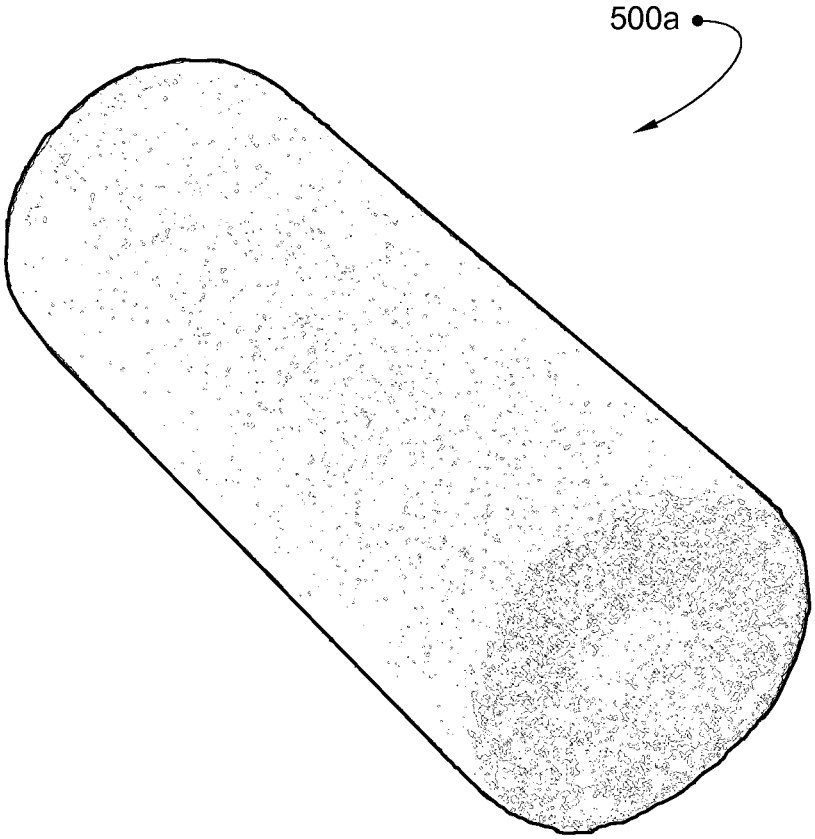
FIG. 6 depicts a perspective view of a cylinder-shaped member in an embodiment.

FIG. 6 depicts a perspective view of a cylinder-shaped member 500*a* made of a resilient, lightweight material in an embodiment. In the illustrated embodiment, the resilient, lightweight member 500*a* is cylinder-shaped but a resilient, lightweight member may include other shapes, preferably with a circular cross-section, such as a disc, a sphere, a cone, or a truncated cone, in order to conform to the pneumatic conduit or pneumatic conduit structure in an embodiment (as depicted in FIGS. 8 & 17.) The resilient, lightweight member 500*a* may be made of an open-cell or a closed-cell foam material including ethylene vinyl acetate foam, polyethylene foam, polystyrene foam, polyurethane foam, latex foam, and other resilient materials such as felt or rubber. For example, the cylinder-shaped member 500*a* may be precisely cut from cross-linked polyethylene foam sheet, preferably about 4 inches thick, using an industrial water jet cutter in an embodiment. Resilient material will not damage or break equipment if a user releases a pneumatic sock during exercise, thereby serving as an impact-resistant bumper. The resilient member 500*a* may also serve as a sound dampening material in an embodiment. The resilient, cylinder-shaped member 500*a* made of foam in an embodiment may add less than one ounce to the weight of a pneumatic sock, thereby keeping acceleration forces low during operation, and may include the central hole (depicted in FIGS. 5A & 5B) as a feature to vary air passage or airflow in an embodiment.

FIG. 7 depicts a perspective view of the pneumatic sock 108*a* with the distal end 204 comprising the lightweight member 500*a* and having the opening 706 for insertion of material in an embodiment. The lightweight member 500*a* may augment the distal end 204 of the pneumatic sock 108*a* to resist the passage of air or airflow in an embodiment. The opening 706 permits the lightweight member 500*a* to be inserted or removed through a side of the pneumatic sock 108*a* in an embodiment. If the distal end 204 is filled with an aggregate of lightweight material that may spill out of the opening 706, a closure such as stitches, a hook & loop fastener, a zipper, or a drawstring may be employed to close the opening 706 in an embodiment. The proximal end 202 of the pneumatic sock 108*a* may be configured to interface with the user's extremity by means of the user interface 203 comprising a handle shaped opening for insertion of the user's hand or foot, in an embodiment. The proximal end 202 and/or the user interface 203 comprising a handle shaped opening may include a lightweight, resilient material for user comfort, such as a neoprene, gel, foam, felt, batting material, or a soft fabric such as fleece or other such material in an embodiment.

Figure 9A:
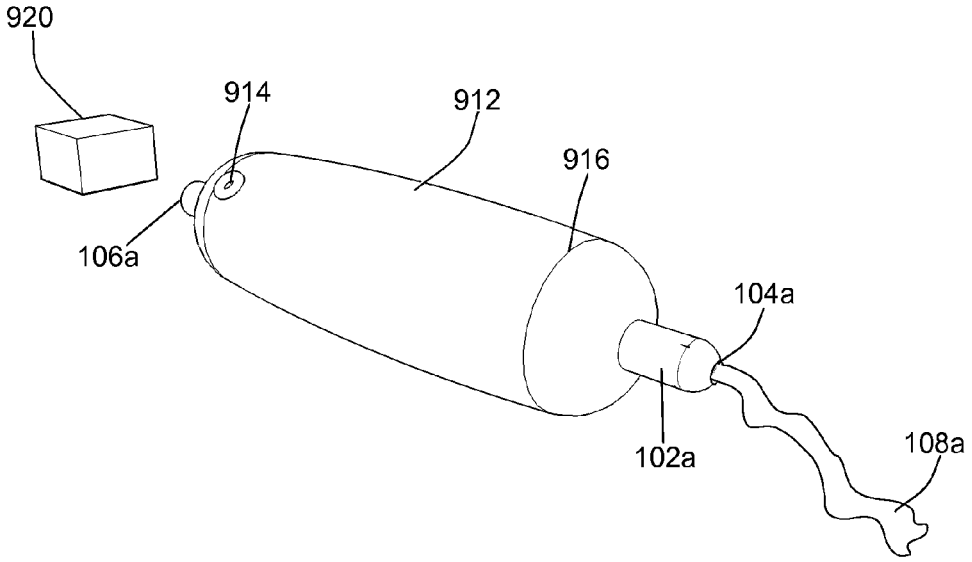
FIG. 9A depicts a perspective view of a pneumatic sock exercise device and an air evacuation source in an embodiment.

FIG. 8 depicts a partial perspective view of a pneumatic sock exercise device in an embodiment illustrating the distal end 204 of the pneumatic sock 108*a* slidably coupled within the pneumatic conduit 102*a*. The secondary opening 106*a* is configured to be removably interfaced with an air evacuation source (as depicted in FIG. 9A) in an embodiment. The distal end 204 of the pneumatic sock 108*a* shuttles within the pneumatic conduit 102*a* when the pneumatic sock 108*a* is moved by a user on a path towards and away from the conduit, whereby the pneumatic sock 108*a* enables airflow within the pneumatic conduit 102*a* to oppose the user and his/her movement of the sock in either direction (with or against airflow) during exercise when the secondary opening 106*a* is interfaced with an air evacuation source in an embodiment. In addition, the pneumatic sock 108*a* may be removable through the secondary opening 106*a* by grasping the distal end 204 and sliding the pneumatic sock 108*a* from the interior of the pneumatic conduit 102*a* with an air evacuation source removed in an embodiment. The distal end 204 of the pneumatic sock 108*a* provides a pressure opposing structure to enable airflow within the pneumatic conduit 102*a* to oppose the user and his/her movement of the sock in either direction (with or against airflow) during exercise.

FIG. 9A depicts a perspective view of a pneumatic sock exercise device in an embodiment comprising the pneumatic conduit 102*a*, the primary opening 104*a*, the secondary opening 106*a* configured to be removably interfaced with an air evacuation source 920, and the pneumatic sock 108*a*. The pneumatic sock 108*a* is slidably coupled within the pneumatic conduit 102*a* and extends through the primary opening 104*a*. (The pneumatic sock 108*a* may include aspects and features of embodiments described in this written description and depicted in FIG. 2A through FIG. 8. & FIG. 17) The pneumatic sock 108*a* may be coupled within the pneumatic conduit 102*a* by removing any fill material or additional members from the pneumatic sock 108*a* and placing the distal end into the primary opening 104*a*, followed by activation of the air evacuation source 920 interfaced with the secondary opening 106*a*. Airflow pulls the pneumatic sock 108*a* into the pneumatic conduit 102*a* through the primary opening 104*a* as the user maintains grasp on the proximal end of the pneumatic sock 108*a*. Then, the air evacuation source 920 may be deactivated and removed from the secondary opening 106*a* to access the distal end of the pneumatic sock 108*a* as depicted in FIG. 8. As depicted in FIG. 7, material may be placed in the distal end of the pneumatic sock 108*a* through the side opening 706. Referring back to FIG. 9A, the distal end of the pneumatic sock 108*a* may be pushed back inside the pneumatic conduit 102*a* through the secondary opening 106*a* after placement of material in the distal end. Exercise may begin when the air evacuation source 920 is subsequently interfaced and re-activated in an embodiment.

A cushion 912 comprising a resilient material, such as natural rubber, synthetic rubber, vulcanized fabric, plastic, foam, gel, or a combination thereof configured as an inflatable bolster to substantially enclose the exterior surface of the pneumatic conduit 102*a* may be included in an embodiment, thereby providing cushioning for a user and providing cushioning between the pneumatic conduit 102*a* and the floor. The cushion 912 may be inflatable with air through at least one opening including at least one air valve 914, such as a hinged lid or a plug that opens and closes, in an embodiment. The cushion 912 may comprise at least one inflatable compartment, including at least one panel of resilient material and at least one seam 916 in an embodiment. Inflation of the cushion 912 with air provides a means of adapting the stability of a pneumatic sock exercise device in an embodiment. For example, it may be advantageous to adapt the stability of an embodiment to facilitate engagement of the user's core muscles during exercise. A source of airflow, such as the air evacuation source 920 adapted as a blower, may be used to inflate the cushion 912 in an embodiment.

Referring to FIG. 9A, the secondary opening 106*a* may be configured with or comprise the connector (as depicted in FIG. 1A), a fitting, a flange, a gasket, a seal, a hose, or a combination thereof to form an interface or connection between the pneumatic conduit 102*a* and the air evacuation source 920. When interfaced or coupled with the air evacuation source 920, air is removed from the pneumatic conduit 102*a* through the secondary opening 106*a* as additional air enters the pneumatic conduit 102*a* through the primary opening 104*a*. The air evacuation source 920 may include a vacuum pump or an exhaust fan in an embodiment. For example, a commercially available vacuum cleaner with a hose attachment may be adapted as the vacuum pump and employed as the air evacuation source 920 in an embodiment. The air evacuation source 920 comprising a variable motor speed control may be employed to vary pneumatic resistance by varying the airflow within the pneumatic conduit 102*a*.

Figure 11:
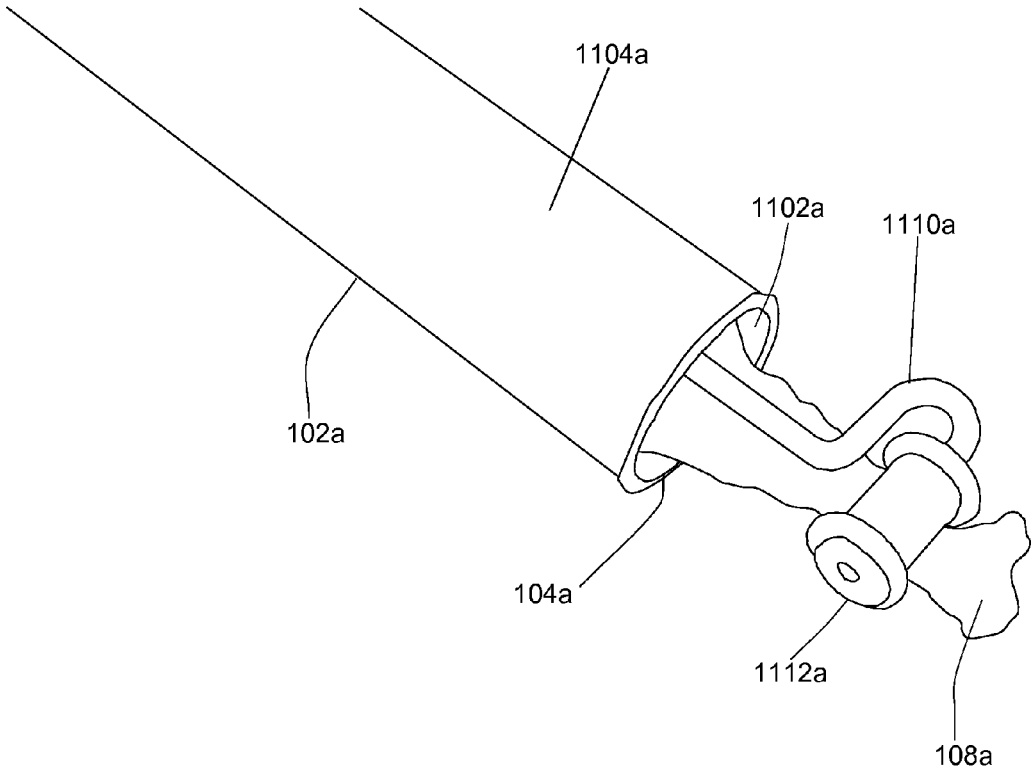
FIG. 11 depicts a partial perspective view of a pneumatic sock exercise device including an extension arm and a pulley in an embodiment.

During operation of the pneumatic sock exercise device depicted in FIG. 9A, the pneumatic sock 108*a* is urged by and in the direction of airflow within the pneumatic conduit 102*a* when the secondary opening 106*a* of the pneumatic conduit structure 102*a* is interfaced with an air evacuation source 920 in an embodiment. The user is able to sit, step, stand, or recline on the pneumatic conduit 102*a*, thereby employing the user's body weight to anchor the embodiment to the floor. As the user moves the pneumatic sock 108*a* on a path towards and away from the primary opening 104*a* of the pneumatic conduit 102*a*, the pneumatic sock 108*a* shuttles along a path adjacent to the interior wall (the interior wall 1102*a* is depicted in FIG. 1C & FIG. 11) within the pneumatic conduit 102*a*. Airflow within the pneumatic conduit 102*a*, urging the pneumatic sock 108*a* in the direction of the airflow, transmits pneumatic resistance to the user as the user moves the pneumatic sock 108*a* on a path towards and away from the primary opening 104*a* of the pneumatic conduit 102*a*. The air evacuation source 920 may be configured with a variable control to vary airflow within the pneumatic conduit 102*a* as a means of varying resistance transmitted to the user. The means of varying resistance transmitted to the user during operation include varying the airflow within the pneumatic conduit 102*a*, varying the diameter of the pneumatic conduit 102*a*, varying the diameter of the primary 104*a* or the secondary opening 106*a*, varying the diameter of the pneumatic sock 108*a*, varying air passage or airflow around and/or through the pneumatic sock 108*a*, or a combination of these aspects.

Figure 9B:
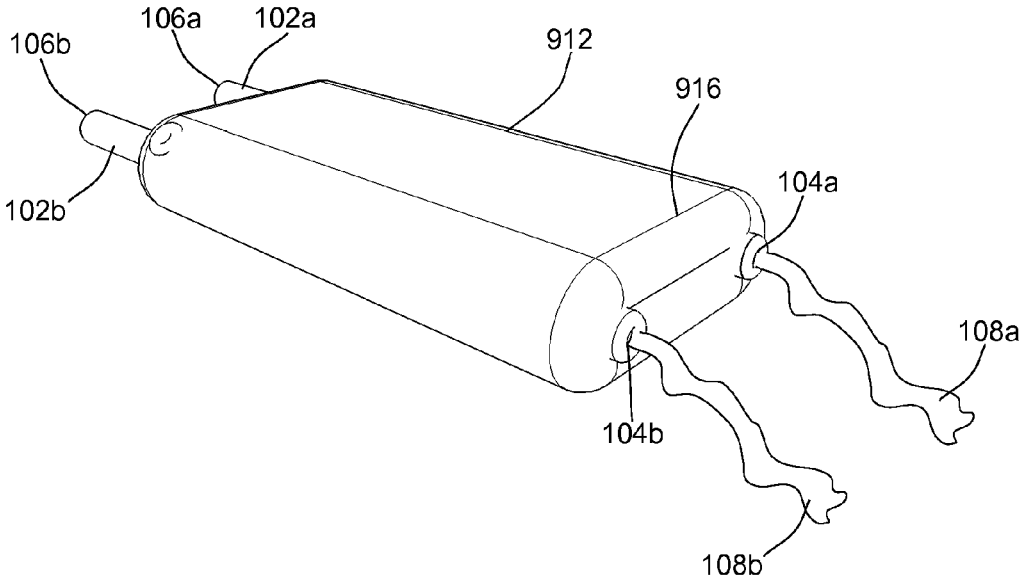
FIG. 9B depicts a perspective view of a pneumatic sock exercise device in an embodiment.

FIG. 9B depicts a perspective view of a pneumatic sock exercise device in an embodiment comprising a pair of pneumatic conduits 102*a*, 102*b*, a pair of primary openings 104*a*, 104*b*, a pair of secondary openings 106*a*, 106*b*, and a pair of pneumatic socks 108*a*, 108*b*. The pneumatic socks 108*a*, 108*b* are slidably coupled within the pneumatic conduits 102*a*, 102*b* and extend through the primary openings 104*a*, 104*b*. (The pneumatic socks 108*a*, 108*b* may include aspects and features of embodiments described in this written description and depicted in FIG. 2A through FIG. 8. & FIG. 17) The cushion 912 comprising a resilient material is configured as an inflatable pad to substantially enclose the exterior walls of the pneumatic conduits 102*a*, 102*b*, thereby providing cushioning for the user and providing cushioning for the pneumatic conduits 102*a*, 102*b* in an embodiment. The cushion 912 may include fasteners to hold the pneumatic conduits 102*a*, 102*b* in place, such as straps with hook & loop fasteners, in an embodiment.

Referring to the air evacuation source 920 in FIG. 9A and the embodiment in FIG. 9B, the secondary openings 106*a*,

106*b* may be configured with or comprise connectors (as depicted in FIG. 1A), fittings, flanges, gaskets, seals, or hoses, or a combination thereof to form an interface or connection between the pneumatic conduits 102*a*, 102*b* and the air evacuation source 920. When interfaced or coupled with the air evacuation source 920, air is removed from the pneumatic conduits 102*a*, 102*b* through the secondary openings 106*a*, 106*b* as additional air enters the pneumatic conduits 102*a*, 102*b* through the primary openings 104*a*, 104*b*. The air evacuation source 920 may include a vacuum pump or an exhaust fan and may comprise a plurality of sources in an embodiment. For example, a commercially available vacuum cleaner may be adapted as a vacuum pump and employed as the air evacuation source 920 with each of the two ends of a bifurcated hose serving as sources interfaced or coupled with the secondary openings 106*a*, 106*b* of the pneumatic conduits 102*a*, 102*b* in an embodiment. In another embodiment, the air evacuation source 920 may be comprised of two sources, such as two vacuum pumps, with each source interfaced with a pneumatic conduit 102*a*, 102*b*. The air evacuation source 920 may be employed to vary pneumatic resistance by varying the airflow within the pneumatic conduit 102*a*.

Figure 10A:
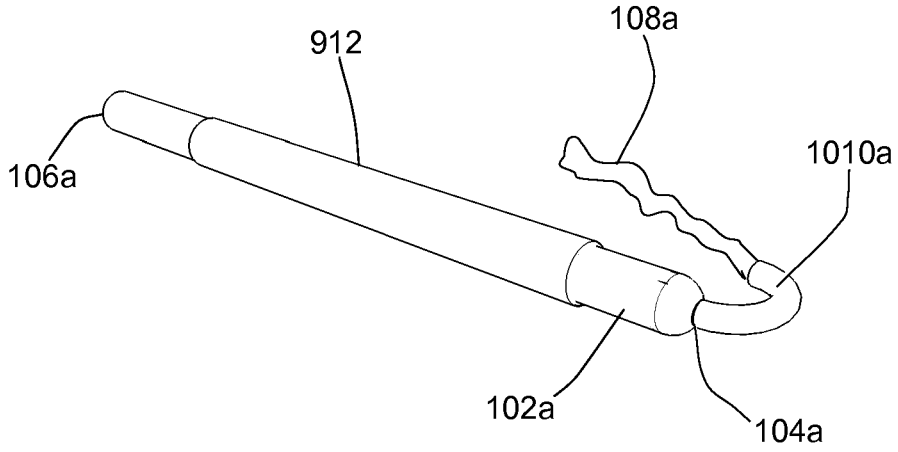
FIG. 10A depicts a perspective view of a pneumatic sock exercise device including an extension tube in an embodiment.

FIG. 10A depicts a perspective view of a pneumatic sock exercise device in an embodiment comprising the pneumatic conduit 102*a* with the primary opening 104*a* and the secondary opening 106*a*, an extension means, which may include an extension tube 1010*a* operatively coupled to the primary opening 104*a* in the pneumatic conduit 102*a*, and a pneumatic sock 108*a*. The pneumatic sock 108*a* is slidably coupled within the pneumatic conduit 102*a* and extends through the primary opening 104*a* and the extension tube 1010*a*. (The pneumatic sock 108*a* may include aspects and features of embodiments described in this written description and depicted in FIG. 2A through FIG. 8 & FIG. 17.) The cushion 912 comprising a resilient material may be configured to substantially enclose the exterior wall (as depicted in FIG. 1C) of the pneumatic conduit 102*a*, thereby providing cushioning for the user and providing cushioning for the pneumatic conduit 102*a* in an embodiment.

The extension tube 1010*a* may be pivotally or rotatably coupled to the primary opening 104*a*, thereby providing a range of substantially unrestricted movement to the pneumatic sock 108*a* extending through the primary opening 104*a* and the extension tube 1010*a* in an embodiment. For example, the primary opening 104*a* may be threaded or have a threaded fitting to allow a threaded end of the extension tube 1010*a* to be screwed or twisted into the primary opening 104*a* to form the rotatable coupling in an embodiment. The extension tube 1010*a* may have a shoulder or a flange to form a buttress for rotating or pivoting against a bushing or a bearing coupled to the primary opening 104*a* in an embodiment. An elastomeric element, such as a rubber sleeve or a rubber donut, may be used to create a flexible coupling to allow twist or limited rotation between the extension tube 1010*a* and the primary opening 104*a* in an embodiment. The primary opening 104*a* may have grooves to couple with an end of the extension tube 1010*a* having splines in an embodiment. A combination of the foregoing aspects and features may be employed to couple the extension tube 1010*a* to the primary opening 104*a* of the pneumatic conduit 102*a* in an embodiment.

The extension tube 1010*a* may be made of a strong, lightweight polymer having a low coefficient of friction, such as nylon, HDPE, or ultra-high molecular weight polyethylene (UHMW-PE), or other such polymers in an embodiment. The interior of the extension tube 1010*a* may include a low friction lining or coating, such as a polytetrafluoroethylene (PTFE) coating, in an embodiment. The extension tube 1010*a* may be straight and/or curved (including any portion of the circumference of a circle), or may comprise a combination of straight and/or curved segments, and may comprise a rigid or a resilient material in an embodiment. The extension tube 1010*a* may also have a flared (e.g., trumpet shaped) opening or a rounded flange at its terminal opening to facilitate movement of the pneumatic sock 108*a* as the pneumatic sock 108*a* extends through the extension tube 1010*a*. The diameter of the extension tube 1010*a* may approximate the diameter of the pneumatic conduit 102*a* but it is preferred that the diameter of the extension tube 1010*a* is less than the diameter of the pneumatic conduit 102*a*. For example, the inside diameter of the extension tube 1010*a* may range from about 1 to 8 inches in an embodiment, with a preferred range of about 1 to 2⅜ inches inside diameter. Extension means refers to a means of providing a range of substantially unrestricted movement to the pneumatic sock 108*a* extending through the primary opening 104*a* of the pneumatic conduit 102*a* such as the extension tube 1010*a* or an extension arm. Extension means and anti-friction means may also include a roller, a wheel, a pulley, a pulley system, a rolling-element bearing, a plain bearing, a flexure bearing, a fluid bearing, or an interior lining or coating with a low coefficient of friction or combinations thereof to extend a range of substantially unrestricted movement to the proximal end of the pneumatic sock 108*a* in an embodiment.

Figure 10B:
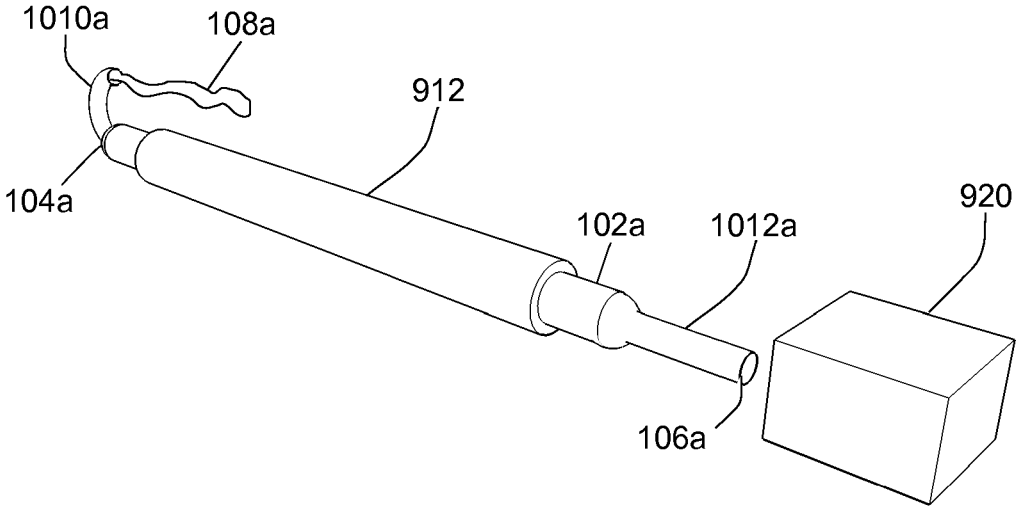
FIG. 10B depicts a perspective view of a pneumatic sock exercise device including an extension tube and an air evacuation source in an embodiment

FIG. 10B depicts a perspective view of a pneumatic sock exercise device in an embodiment comprising the pneumatic conduit 102*a*, the primary opening 104*a*, the secondary opening 106*a* configured to be removably interfaced with the air evacuation source 920, the extension tube 1010*a* operatively coupled to the primary opening 104*a* in the pneumatic conduit 102*a*, and the pneumatic sock 108*a*. The pneumatic sock 108*a* is slidably coupled within the pneumatic conduit 102*a* and extends through the primary opening 104*a* and the extension tube 1010*a*. (The pneumatic sock 108*a* may include aspects and features of embodiments described in this written description and depicted in FIG. 2A through FIG. 8 & FIG. 17.) The secondary opening 106*a* may be configured with a flange, a gasket, a seal, a hose 1012*a*, or a combination thereof to form an interface or connection between the pneumatic conduit 102*a* and the air evacuation source 920. The cushion 912 comprising a resilient material may be configured to substantially enclose the exterior walls (as depicted in FIG. 1C) of the pneumatic conduit 102*a*, thereby providing cushioning for the user and providing cushioning for the pneumatic conduit 102*a* in an embodiment.

FIG. 11 depicts a partial perspective view of a pneumatic sock exercise device in an embodiment with the pneumatic sock 108*a* slidably coupled within the pneumatic conduit 102*a* having interior and exterior walls 1102*a*, 1104*a* and further including an extension arm 1110*a* and a pulley 1112*a* operatively mounted in a position adjacent to the primary opening 104*a*. The pneumatic sock 108*a* shuttles along a path adjacent to the interior wall 1102*a* within the pneumatic conduit 102*a* when the pneumatic sock 108*a* is moved by a user on a path toward and away from the conduit. The pneumatic sock 108*a* is able to bear upon the pulley 1112*a* when the pneumatic sock 108*a* is engaged by a user, with the extension arm 1110*a* extending the range of movement of the pneumatic sock 108*a* away from the primary opening 104*a* in an embodiment. The extension arm 1110*a* may be pivotally or rotatably mounted to either the pneumatic conduit 102*a* or a housing or frame in a position adjacent to the primary opening 104*a* in an embodiment. In addition, the extension arm 1110*a* may be straight and/or curved or may comprise a combination of straight and/or curved segments in an embodiment. The extension arm 1110*a* may be configured with the pulley 1112*a*, a pulley system, a roller, a wheel, a rolling-element bearing, a plain bearing, a flexure bearing, a fluid bearing, or a lining or coating with a low coefficient of friction or a combination thereof to extend the range of movement of the pneumatic sock 108*a* away from the primary opening 104*a* in an embodiment.

Figure 12A:
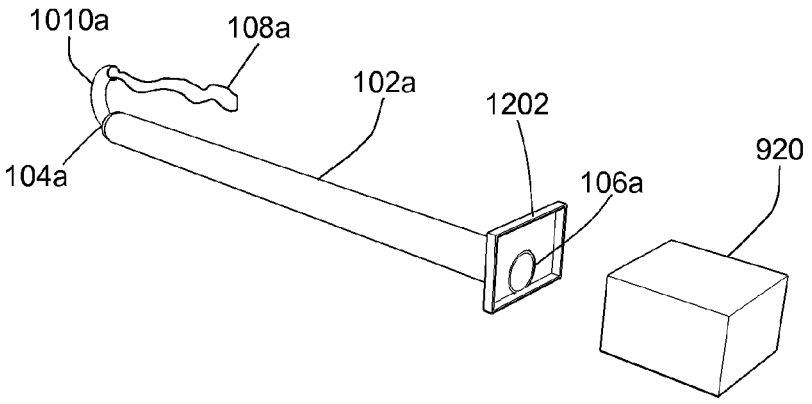
FIG. 12A depicts a perspective view of a pneumatic sock exercise device and an air evacuation source in an embodiment.

FIG. 12A depicts a perspective view of a pneumatic sock exercise device in an embodiment comprising the pneumatic conduit 102*a*, the primary opening 104*a* operatively coupled to the extension tube 1010*a*, a housing 1202 comprising the secondary opening 106*a* configured to be removably interfaced with the air evacuation source 920, and the pneumatic sock 108*a* extending through the extension tube 1010*a*. The pneumatic sock 108*a* is slidably coupled within the pneumatic conduit 102*a* and extends through the primary opening 104*a* and the extension tube 1010*a*. (The pneumatic sock 108*a* may include aspects and features of embodiments described in this written description and depicted in FIG. 2A through FIG. 8 & FIG. 17.) The housing 1202 may comprise a frame configured with a flange, gasket, seal, or a combination thereof to removably interface the pneumatic conduit 102*a* and the air evacuation source 920. When interfaced or coupled with the air evacuation source 920, air is removed from the pneumatic conduit 102*a* through the secondary opening 106*a* and air enters the pneumatic conduit 102*a* through the extension tube 1010*a* and the primary opening 104*a*. The air evacuation source 920 may include a vacuum pump or an exhaust fan in an embodiment.

Figure 12B:
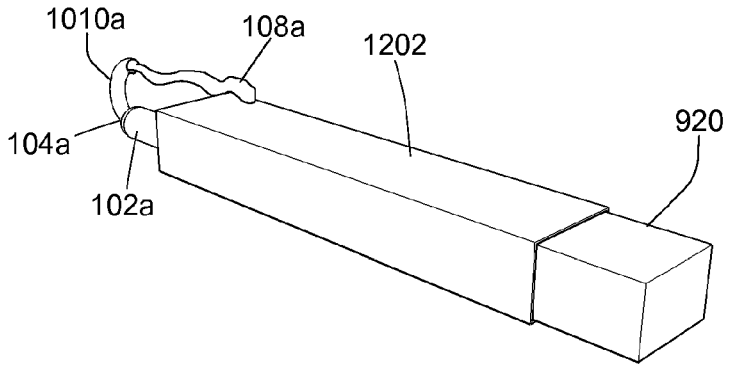
FIG. 12B depicts a perspective view of a pneumatic sock exercise device and an air evacuation source in an embodiment.

FIG. 12B depicts a perspective view of a pneumatic sock exercise device interfaced with the air evacuation source 920 in an embodiment comprising the pneumatic conduit 102*a*, the primary opening 104*a* operatively coupled to the extension tube 1010*a*, the housing 1202 comprising the secondary opening interfaced with the air evacuation source 920, and the pneumatic sock 108*a* extending through the extension tube 1010*a*. The pneumatic sock 108*a* is slidably coupled within the pneumatic conduit 102*a* and extends through the primary opening 104*a* and the extension tube 1010*a*. (The pneumatic sock 108*a* may include aspects and features of embodiments described in this written description and depicted in FIG. 2A through FIG. 8 & FIG. 17.) The housing 902 may comprise a frame configured with a flange, gasket, seal, or a combination thereof to removably interface the pneumatic conduit 102*a* and the air evacuation source 920.

During operation of a pneumatic sock exercise device as depicted in FIGS. 12A & 12B, the pneumatic sock 108*a* is urged by and in the direction of airflow within the pneumatic conduit 102*a* when the secondary opening 106*a* of the pneumatic conduit structure 102*a* is interfaced with an air evacuation source 920 in an embodiment. As the user moves the pneumatic sock 108*a* on a path towards and away from the primary opening 104*a* of the pneumatic conduit 102*a*, the pneumatic sock 108*a* shuttles along a path adjacent to the interior wall (the interior wall 1102*a* is depicted in FIG. 11) within the pneumatic conduit 102*a*. Airflow within the pneumatic conduit 102*a*, urging the pneumatic sock 108*a* in the direction of airflow, transmits pneumatic resistance to the user as the user moves the pneumatic sock 108*a* on a path towards and away from the primary opening 104*a* of the pneumatic conduit 102*a*. The air evacuation source 920 may be configured with a variable control to vary airflow within the pneumatic conduit 102*a* as a means of varying resistance transmitted to the user. The means of varying resistance transmitted to the user during operation of a pneumatic sock exercise device includes varying the airflow within the pneumatic conduit 102*a*, varying the diameter of the pneumatic conduit 102*a*, varying the diameter of the primary 104*a* or the secondary opening 106*a*, varying the diameter of the pneumatic sock 108*a*, varying air passage around and/or through the pneumatic sock 108*a*, or a combination of these aspects.

Figure 13:
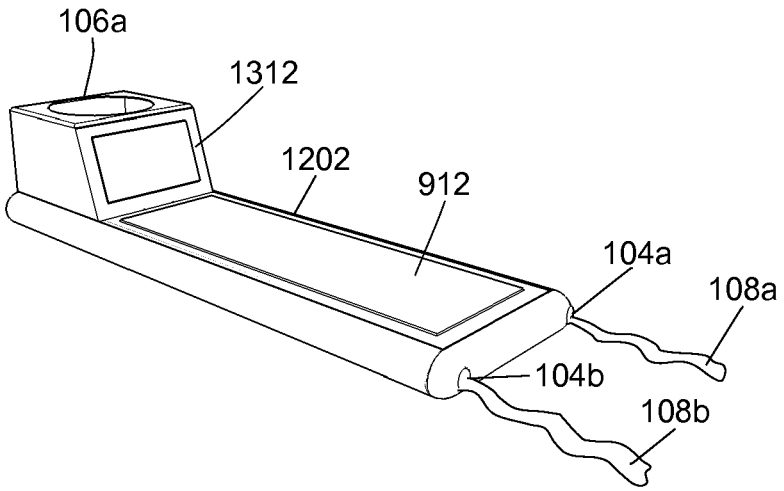
FIG. 13 depicts a perspective view of a pneumatic sock exercise device in an embodiment.

FIG. 13 depicts a perspective view of a pneumatic sock exercise device comprising a housing and pneumatic conduit structure 1202 having a pair of primary openings 104*a*, 104*b*, a secondary opening 106*a*, and a pair of pneumatic socks 108*a*, 108*b* in an embodiment. The pneumatic socks 108*a*, 108*b* are slidably coupled within the housing and pneumatic conduit structure 1202 and extend through the primary openings 104*a*, 104*b*. (The pneumatic socks 108*a*, 108*b* may include aspects and features of embodiments described in this written description and depicted in FIG. 2A through FIG. 8 & FIG. 17.) The primary openings 104*a*, 104*b* may be configured with rounded flanges (as depicted in FIG. 1A) or a flared (e.g., trumpet shaped) openings. The primary openings 104*a*, 104*b* may also include a roller, wheel, pulley, pulley system, rolling-element bearing, plain bearing, flexure bearing, fluid bearing, or an interior lining or coating with a low coefficient of friction or combinations thereof to provide a range of substantially unrestricted movement to the proximal end of the pneumatic socks 108*a*, 108*b* in an embodiment. The cushion 912 comprising a resilient material, such as natural rubber, synthetic rubber, vulcanized fabric, plastic, neoprene, foam, gel, or a combination thereof, configured to the exterior of the housing and pneumatic conduit structure 902 may be included to cushion the user in an embodiment. The cushion 912 may be inflatable with air in an embodiment. The housing and pneumatic conduit structure 1202 may comprise a seat with a back support 1312 in an embodiment.

The housing and pneumatic conduit structure 1202 comprises both housing or frame and pneumatic conduit(s) 102*a* in one structure. It is advantageous for the housing and pneumatic conduit structure 1202 to be of a lightweight and portable construction and to be capable of supporting a user to employ the user's body weight to anchor an embodiment to the floor. The housing and pneumatic conduit structure 1202 comprises pneumatic conduits by utilizing contemporary manufacturing techniques with polymer materials. There are a number of strong, lightweight polymers that may be used in the fabrication of the housing and pneumatic conduit structure 1202 including acrylonitrile butadiene styrene (ABS), acrylic, nylon, polyester, polyethylene, polycarbonate, polypropylene, and polyvinyl chloride using a variety of different manufacturing methods.

One of the most economical methods for fabricating an embodiment of the housing and pneumatic conduit structure 1202 as depicted in FIG. 13 is by rotational molding, although other techniques for polymer fabrication (e.g. injection molding) may be employed. The most commonly used family of polymers in rotational molding is polyethylene, which includes cross linked polyethylene (XLPE), low-density polyethylene (LDPE), linear medium-density polyethylene (LMDPE), high-density polyethylene (HDPE), and ultra-high molecular weight polyethylene (UHMW-PE). Polyethylene is also easily cut, drilled, heat formed, shaped, and welded with a plastic welder. In addition to the ease of manufacturing with polyethylene, it has other properties that make it advantageous for the fabrication of the housing and pneumatic conduit structure 902. For example, HDPE is lightweight, strong, easy to machine, and inexpensive, which are advantageous characteristics for the housing and pneumatic conduit structure 902 in an embodiment.

Figure 14:
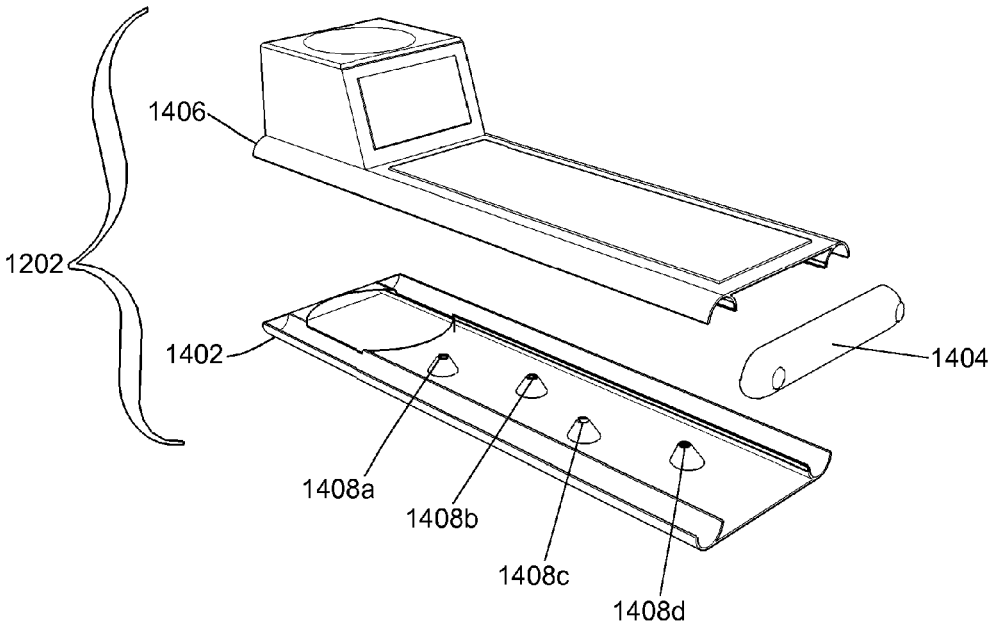
FIG. 14 depicts an exploded perspective view of a housing and pneumatic conduit structure in an embodiment.

FIG. 14 depicts an exploded perspective view of the housing and pneumatic conduit structure 1202 in an embodiment.

An upper portion 1406, a lower portion 1402, and a front portion 1404 are illustrated which may be apparent during manufacture. An embodiment of the housing and pneumatic conduit structure 1202 may include the upper portion 1406 and the lower portion 1402 fastened or welded together with the front portion 1404 coupled to the joined portions as a removable structure or the housing and pneumatic conduit structure 1202 may include the upper portion 1406, the lower portion 1402, and the front portion 1404 fastened or welded together. The front portion 1404 may be rounded or may include a rounded flange in an embodiment. The housing and pneumatic conduit structure 1202 may have a plurality of structural support ribs 1408*a*, 1408*b*, 1408*c*, 1408*d*. A predetermined number, size, and configuration of structural support ribs 1408*a*, 1408*b*, 1408*c*, 1408*d* strengthen the housing and pneumatic conduit structure 1202 and structural support ribs may be configured in the lower portion 1402, the upper portion 1406 or both portions in an embodiment.

Figure 15:
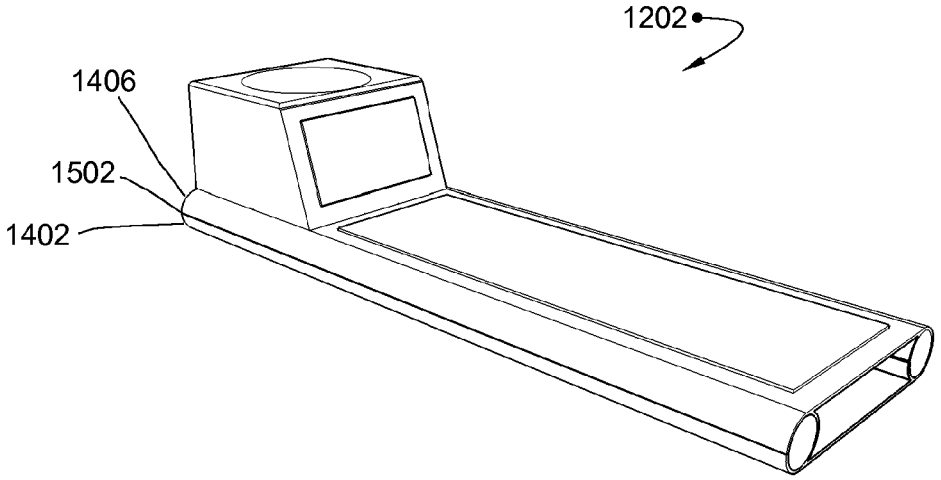
FIG. 15 depicts a perspective view of a housing and pneumatic conduit structure with the front portion removed in an embodiment.

FIG. 15 depicts a perspective view of the housing and pneumatic conduit structure 1202 with the front portion removed in an embodiment. The upper portion 1406 and the lower portion 1402 are illustrated with a joint 1502, which may be inconspicuous after finishing, depending on the method of manufacture. Fastening or welding the upper portion 1406 and the lower portion 1402 of the housing and pneumatic conduit structure 1202 forms the pneumatic conduit structures in the interior. In order for the joint 1502 to be substantially airtight, a gasket or a seal may be placed between the upper portion 1406 and the lower portion 1402 prior to fastening or welding the portions together.

Figure 16:
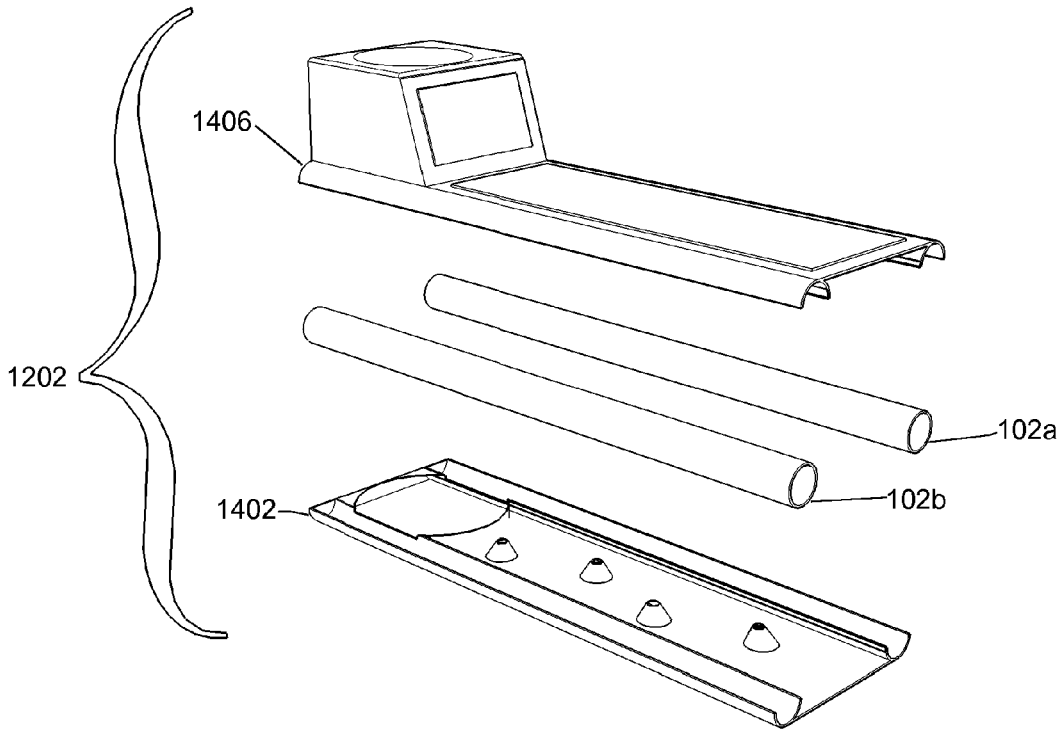
FIG. 16 depicts an exploded perspective view of a housing and pneumatic conduit structure with the front portion removed with additional pneumatic conduits in an embodiment.

FIG. 16 depicts an exploded perspective view of the housing and pneumatic conduit structure 1202 with the front portion removed and additional pneumatic conduits 102*a*, 102*b* in an embodiment. The fabrication of the housing and pneumatic conduit structure 1202 may include the upper portion 1406, the lower portion 1402, and additional pneumatic conduits 102*a*, 102*b* joined together during manufacture in an embodiment. Additional pneumatic conduits 102*a*, 102*b* may be added to either the upper portion 1406 or the lower portion 1402 as finished pieces, prior to the joining of the portions in an embodiment.

FIG. 17 depicts an exploded perspective view of a pneumatic sock exercise device in an embodiment with the front portion removed and a pair of pneumatic socks 108*a*, 108*b* slidably coupled therein, with arrows to indicate direction of airflow during operation. The distal ends 204*a*, 204*b* of the pneumatic socks 108*a*, 108*b* are capable of slidable movement along a path adjacent to the interior walls 1102*a*, 1102*b* of the pneumatic conduit structure 1202 when the proximal ends 202*a*, 202*b* of the pneumatic socks 108*a*, 108*b* are moved by a user on a path towards and away from the pneumatic conduit structure 1202, whereby the pneumatic socks 108*a*, 108*b* enable airflow within the pneumatic conduit structure 1202 to oppose the user and his/her movement of the sock in either direction (with or against airflow) during exercise.

Figure 18:
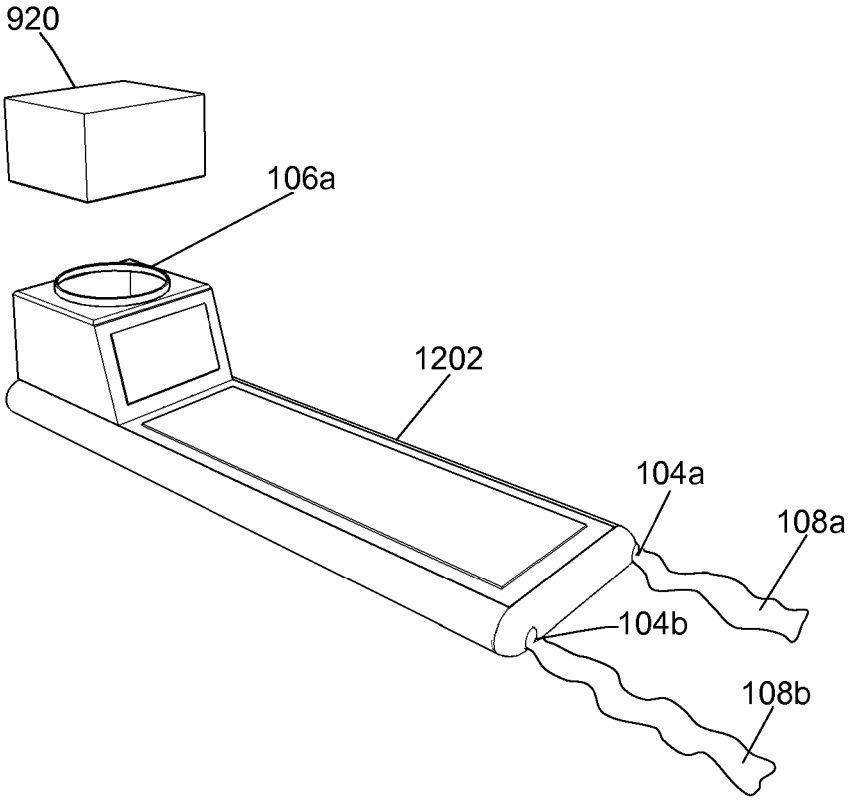
FIG. 18 depicts a perspective view of a pneumatic sock exercise device and an air evacuation source in an embodiment.

As indicated by the arrows in FIG. 17, the distal ends 204*a*, 204*b* of the pneumatic socks 108*a*, 108*b* are urged by and in the direction of airflow when the pneumatic conduit structure 1202 having interior walls 1102*a*, 1102*b* and exterior walls 1104*a*, 1104*b* is interfaced with the air evacuation source 920 (as depicted in FIG. 18) in an embodiment. As the user moves the proximal ends 202*a*, 202*b* of the pneumatic socks 108*a*, 108*b* on a path towards and away from the pneumatic conduit structure 1202, the distal ends 204*a*, 204*b* of the pneumatic socks shuttle along a path adjacent to the interior walls 1102*a*, 1102*b* within the pneumatic conduit structure 1202. Airflow around and through the distal ends 204*a*, 204*b* of the pneumatic socks 108*a*, 108*b*, merging in a unified portion 1702 of the pneumatic conduit structure 1202, exits through the secondary opening 106*a*. Airflow within the pneumatic conduit structure 1202, urging the distal ends 204*a*, 204*b* of the pneumatic socks 108*a*, 108*b*, in the direction of airflow, transmits pneumatic resistance to the user as the user moves the proximal ends 202*a*, 202*b* on a path towards and away from the pneumatic conduit structure 1202. The proximal ends 202*a*, 202*b* of the pneumatic socks 108*a*, 108*b* comprise user interfaces and the distal ends 204*a*, 204*b* of the pneumatic socks 108*a*, 108*b* comprise pressure opposing structures to enable air within the pneumatic conduit structure 1202 to oppose the user and his/her movement of the sock in either direction (with or against airflow) during exercise.

FIG. 18 depicts a perspective view of the pneumatic sock exercise device in an embodiment comprising the housing and pneumatic conduit structure 1202, the primary openings 104*a*, 104*b*, the secondary opening 106*a* configured to be removably interfaced with the air evacuation source 920, and the pneumatic socks 108*a*, 108*b*. The pneumatic socks 108*a*, 108*b* are slidably coupled within the housing and pneumatic conduit structure 1202 and extend through the primary openings 104*a*, 104*b*. (The pneumatic socks 108*a*, 108*b* may include aspects and features of embodiments described in this written description and depicted in FIG. 2A through FIG. 8 & FIG. 17) The housing and pneumatic conduit structure 1202 may be configured with the secondary opening 106*a* having a flange, gasket, seal or a combination thereof to removably interface the housing and pneumatic conduit structure 1202 and the air evacuation source 920. Fasteners, such as clasps or buckles, may be used to hold the air evacuation source 920 in place when interfaced with the secondary opening 106*a* of the housing and pneumatic conduit structure 1202 in an embodiment. When interfacing with the air evacuation source 920, air is removed from the housing and pneumatic conduit structure 1202 through the secondary opening 106*a* and air enters through the primary openings 104*a*, 104*b*. The air evacuation source 920 may include a vacuum pump or an exhaust fan. For example, a commercially available utility or wet/dry vacuum with tank removed may be adapted as the vacuum pump and employed as the air evacuation source 920 removably interfacing or coupling with the pneumatic sock exercise device in an embodiment.

During operation of an embodiment of a pneumatic sock exercise device as depicted in FIG. 18, the pneumatic socks 108*a*, 108*b* are urged by and in the direction of airflow within the housing and pneumatic conduit structure 1202 when the secondary opening 106*a* is interfaced with an air evacuation source 920 in an embodiment. As the user moves the pneumatic socks 108*a*, 108*b* on a path towards and away from the primary openings 104*a*, 104*b* of the pneumatic conduit structure 1202, the pneumatic socks 108*a*, 108*b* shuttle along a path adjacent to the interior walls (the interior walls 1102*a*, 1102*b* are depicted in FIG. 17) within the pneumatic conduit structure 1202. Airflow within the pneumatic conduit structure 1202, urging the pneumatic socks 108*a*, 108*b*, in the direction of airflow, transmits pneumatic resistance to the user as the user moves the pneumatic socks 108*a*, 108*b* on a path towards and away from the primary openings 104*a*, 104*b* of the pneumatic conduit structure 1202. The air evacuation source 920 may be configured with a variable control to vary airflow within the housing and pneumatic conduit structure 1202 as a means of varying resistance transmitted to the user. The means of varying resistance transmitted to the user during operation of the pneumatic sock exercise device include varying the airflow within the housing and pneumatic conduit structure 1202, varying the diameter of the pneumatic conduit structure 1202, varying the diameter of the primary 104*a*, 104*b* or the secondary opening 106*a*, varying the diameter of the pneumatic socks 108*a*, 108*b*, varying air passage or airflow around and/or through the pneumatic socks 108*a*, 108*b*, or a combination of these aspects.

In conclusion, embodiments of the pneumatic sock exercise device comprise the benefits of pneumatic resistance in a device that is lightweight, compact, and affordable for the typical exercise consumer at home or at a smaller facility. Complicated moving parts and imposing frames that are typical of traditional design are replaced with a less complicated and more contemporary design comprising various embodiments of the pneumatic sock exercise device. Consequently, it is anticipated that various embodiments of the pneumatic sock exercise device will facilitate greater exercise participation by the typical exercise consumer.

Although the pneumatic sock exercise device has been described in the context of various aspects, features and embodiments, it will be apparent to those skilled in the art that the pneumatic sock exercise device encompasses alternate embodiments, ramifications, and/or uses beyond the specifically disclosed embodiments. For example, the pneumatic sock exercise device may include alternate embodiments with housing or frame elements that have not been specifically disclosed. An alternate embodiment of a pneumatic sock exercise device may be attached to a separate housing or frame instead of, or in addition to, an integrated housing or frame structure. The pneumatic sock exercise device may include alternate embodiments with elements or components in a different orientation from those illustrated (e.g., vertically oriented pneumatic conduits instead of horizontal.) Alternate embodiments may also include any number of pneumatic socks and/or pneumatic conduits in a specific embodiment. For example, an alternate embodiment of a pneumatic sock exercise device may include four pneumatic socks and four pneumatic conduits in an embodiment for a user to engage all four extremities during exercise. The pneumatic sock exercise device may include pneumatic conduits with non-circular cross sections, such as rectangular or oval cross-sections, and pneumatic socks conforming to the shape of non-circular pneumatic conduits in an alternate embodiment. Alternate embodiments may be adapted or used for any suitable exercise or method of exercise as would be contemplated by one skilled therein. Alternate embodiments may be adapted for uses or operated in manners that have not been specifically disclosed (e.g., the physical simulation of rowing.) It is also contemplated that various combinations or substitution of equivalents of the disclosed aspects, features, and embodiments may be made within the scope of the pneumatic sock exercise device. Thus, it is intended that the scope of the pneumatic sock exercise device herein disclosed should not be limited by the particular disclosed embodiments described above for the purpose of fulfilling statutory requirements, but should be determined by a fair reading of the claims that follow.

I claim:

1. An exercise device for use by a user, comprising:

a pneumatic conduit having interior and exterior walls and a plurality of openings facilitating the flow of air through the conduit, wherein the conduit is further configured to be interfaced with a source of airflow;

a cushion comprising a resilient material affixed to one or more of the exterior walls of the pneumatic conduit;

a lightweight material slidably engaged with the pneumatic conduit, the lightweight material having structure to oppose airflow within the pneumatic conduit;

a user interface coupled with the lightweight material, the user interface being accessible wholly outside of the pneumatic conduit; and an extension means coupled with the user interface;

the device being configured such that the lightweight material shuttles along a path adjacent to the interior walls of the pneumatic conduit when the user interface is moved on a path towards and away from the pneumatic conduit.

2. The exercise device of claim 1 wherein the cushion is affixed to a top wall and a bottom wall of the exterior walls of the pneumatic conduit.

3. The exercise device of claim 1 wherein the lightweight material comprises a resilient member with a central hole.

4. The exercise device of claim 1 wherein the lightweight material comprises a resilient, cylinder-shaped member.

5. The exercise device of claim 1 wherein one of the openings comprises a connector to interface with the source of airflow.

6. The exercise device of claim 1 wherein the user interface is coupled with the lightweight material by means of a cord.

7. The exercise device of claim 1 wherein the user interface comprises a handle.

8. The exercise device of claim 1 wherein the user interface comprises a structure with an opening configured to receive a user's hand or foot.

9. The exercise device of claim 1 wherein the lightweight material comprises a tubular structure of slick material.

10. The exercise device of claim 1 wherein the user interface is coupled with the lightweight material by means of a flexible material selected from the group consisting of fabric, mesh and combinations thereof.

11. The exercise device of claim 1 wherein the extension means is an extension tube and is coupled with one of the openings of the pneumatic conduit.

12. The exercise device of claim 1 wherein the extension means comprises a rounded flange.

13. The exercise device of claim 1 wherein the extension means is an extension arm operably mounted to the pneumatic conduit in a position adjacent to one of the openings.

14. An exercise device for use by a user, comprising:

a housing;

a pneumatic conduit positioned within the housing having interior and exterior walls and a plurality of openings facilitating the flow of air through the conduit, wherein the conduit is configured to interface with a source of airflow;

a cushion comprising a resilient material affixed to one or more of the exterior walls of the housing;

a lightweight material slidably engaged within the pneumatic conduit, the lightweight material having structure to oppose airflow within the pneumatic conduit;

a user interface coupled with the lightweight material, the user interface being accessible wholly outside of the pneumatic conduit; and an extension means coupled with the user interface the device being configured such that the lightweight material shuttles along a path adjacent to the interior wall of the pneumatic conduit when the user interface is moved on a path towards and away from one of the openings of the pneumatic conduit.

15. The exercise device of claim 14 wherein the housing comprises a seat configured to support the user.

16. The exercise device of claim 14 wherein the lightweight material comprises fabric.

17. A method of exercising comprising the steps of: (a) employing a user's body weight on an exercise device for anchoring the exercise device to the floor before starting exercise movements, the exercise device comprising a pneumatic conduit having a plurality of openings facilitating the flow of air through the conduit, a pneumatic sock coupled with the pneumatic conduit, and a user interface coupled with the pneumatic sock, (b) attaching the pneumatic sock to the user at the user interface, being wholly outside of the pneumatic conduit, (c) by means of pulling the user interface away from the pneumatic conduit, moving the pneumatic sock on a path away from an opening of the pneumatic conduit, and (d) by means of controllably allowing the user interface to return towards the pneumatic conduit, moving the pneumatic sock on a path towards the opening of the pneumatic conduit.

18. The method of claim 17, step (a) wherein the method of employing the user's body weight is selected from the group consisting of sitting, stepping, standing, and reclining.

19. The method of claim 17 wherein the user interface is formed from the proximal end of the pneumatic sock.

* * * * *